United States Patent [19]

Murata

[11] Patent Number: 5,005,461

[45] Date of Patent: Apr. 9, 1991

[54] PLUCKING-SOUND GENERATION INSTRUMENT AND PLUCKING-DATA MEMORY INSTRUMENT

[75] Inventor: Yoshiyuki Murata, Tachikawa, Japan

[73] Assignee: Casio Computer Co., Ltd., Tokyo, Japan

[21] Appl. No.: 340,235

[22] Filed: Apr. 19, 1989

[30] Foreign Application Priority Data

Apr. 25, 1988 [JP] Japan ..... 63-54538[U]

[51] Int. Cl.[5] ..... G10H 7/04; G10F 1/16

[52] U.S. Cl. ..... 84/646; 84/470 R; 84/477 R; 84/605; 84/DIG.30

[58] Field of Search ..... 84/477 R, DIG. 30, 633, 84/646, 724, 725, 638, 470 R, 605, 616, 626

[56] References Cited

U.S. PATENT DOCUMENTS

| | | | |
|---|---|---|---|
| 4,078,464 | 3/1978 | Sugiyama | 84/744 |
| 4,080,867 | 3/1978 | Ratanangsu | 84/477 R |
| 4,217,804 | 8/1980 | Yamaga et al. | 84/638 |
| 4,235,141 | 11/1980 | Eventoff | 84/672 |
| 4,248,128 | 2/1981 | Des Gaines | 84/322 |
| 4,295,402 | 10/1981 | Deutsch et al. | 84/715 |
| 4,321,852 | 3/1982 | Young, Jr. | 84/646 |
| 4,336,734 | 6/1982 | Polson | 84/646 |
| 4,339,979 | 7/1982 | Norman | 84/627 |
| 4,653,376 | 3/1987 | Allured et al. | 84/646 |
| 4,658,690 | 4/1987 | Aitken et al. | 84/629 |
| 4,723,468 | 2/1988 | Takabayashi et al. | 84/722 |
| 4,748,887 | 6/1988 | Marshall | 84/DIG. 30 |

*Primary Examiner*—Geoffrey S. Evans

*Attorney, Agent, or Firm*—Frishauf, Holtz, Goodman & Woodward

[57] ABSTRACT

An instrument which automatically generates plucking sounds responsive a player's manual fingering operation performed on an electronic stringed instrument, and also to a memory instrument which stores plucking data for generating the plucking sounds. When fingering operation is performed on a fingerboard, an output section thereof outputs pitch data. Plucking data are sequentially read out from a memory section thereof. On the basis of the pitch data and the plucking data, a musical tone generating section automatically and sequentially generates plucking sounds each having a tone pitch corresponding to the pitch data, without a manual plucking operation of the player.

46 Claims, 20 Drawing Sheets

| FRET POSITIONS | FRET NUMBERS | | | | |
|---|---|---|---|---|---|
| OPEN STRING FRET | 0 | 0 | 0 | 0 | 0 |
| 1ST FRET | 0 | 0 | 0 | 0 | 1 |
| 2ND FRET | 0 | 0 | 0 | 1 | 0 |
| 3RD FRET | 0 | 0 | 0 | 1 | 1 |
| ⋮ | | | ⋮ | | |
| 21ST FRET | 1 | 0 | 1 | 0 | 1 |
| 22ND FRET | 1 | 0 | 1 | 1 | 0 |

| MEMORY ADDRESS | MEMORY CONTENTS OF PLUCKING DATA | | |
|---|---|---|---|
| | STRING NUMBER | PLUCKING FORCE | PLUCKING TIMES |
| 1 | 101 (6TH STRING) | 111 (MAX) | $t_1$ |
| 2 | 100 (5TH STRING) | 101 (MEDIUM) | $t_2$ |
| 3 | 011 (4TH STRING) | 100 (MEDIUM) | $t_3$ |
| 4 | 010 (3RD STRING) | 100 (MEDIUM) | $t_4$ |
| 5 | 001 (2ND STRING) | 100 (MEDIUM) | $t_5$ |
| 6 | 000 (1ST STRING) | 011 (SOFT) | $t_6$ |
| 7 | 101 (6TH STRING) | 111 (MAX) | $t_7$ |
| 8 | 100 (5TH STRING) | 111 (MAX) | $t_8$ |
| 9 | 011 (4TH STRING) | 111 (MAX) | $t_9$ |
| 10 | | 111 | $t_{10}$ |

FIG. 6E

| STRINGS \ TINMINGS | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 6TH STRING | ○ | | | | ○ | | | | ○ | | | | ○ | | | |
| 5TH STRING | ○ | | | | ○ | | | | ○ | | | | ○ | | | |
| 4TH STRING | ○ | | | | ○ | | | | ○ | | | | ○ | | | |
| 3RD STRING | ○ | | | | ○ | | | | ○ | | | | ○ | | | |
| 2ND STRING | ○ | | | | ○ | | | | ○ | | | | ○ | | | |
| 1ST STRING | ○ | | | | ○ | | | | ○ | | | | ○ | | | |
| PLUCKIN FORCE | 100 | | | | 111 | | | | 100 | | | | 111 | | | |

PLUCKING-SOUND GENERATION INSTRUMENT AND PLUCKING-DATA MEMORY INSTRUMENT

BACKGROUND OF THE INVENTION

1. Field of the Invention

The present invention relates to a plucking-sound generation instrument which sequentially generates one plucking sound or a plurality of plucking sounds at the same time or at predetermined time intervals in accordance with plucking data, and to a plucking-data memory instrument which is capable of storing plucking data at real time or in a step fashion, which plucking data are used to generate plucking sounds to be generated at the same time or at predetermined time intervals.

2. Description of the Related Art

Recently, various electronic musical instruments have been developed which utilize advances made in electronic technology. Among these electronic musical instruments are electronic stringed instruments such as electronic violins, electronic guitars and guitar synthesizers, as well as electronic keyboard instruments such as electronic pianos and electronic organs.

In general, it, as a matter of course, requires strict and time consuming training to adequately master how to play a musical instrument such as a conventional acoustic musical instrument and an electronic musical instrument utilizing electronic technology. A beginner player who plays an unfamiliar instrument for the first time and a player who has not yet been well trained in performance technique of an instrument may usually feel hard to express their intended music through performance of the instrument. Therefore, it will be very useful to provide the beginner players and the not well trained players with a tool which helps these players with expressing their intended music.

One aspect of this kind of tool has been already available as automatic playing instruments in the field of the electronic keyboard instrument. For example, an electronic keyboard instrument is disclosed in U.S. Pat. No. 4,217,804, which automatically performs arpeggios in accordance with operated-key information supplied from the keyboard and arpeggio-pattern information from the arpeggio-pattern generator. This musical instrument is provided with assignment means for assigning a pitch-order property to each of tone pitches of a plurality of operated keys, and an arpeggio-pattern generator for generating pitch-order properties at the timings when each musical tone is to be generated. The pitch-order property data of the generated arpeggio pattern is decoded referring to the correspondence between the pitch-order property of the operated key and the pitch, thereby forming a pitch representing a particular frequency. Then a musical tone having the decoded pitch is generated. But this instrument does not generate musical tones having pitches other than those specified by the operated keys.

The instrument of the above construction, however, basically has a keyboard of one row pitch or key arrangement and the instrument has been developed with reference to a musical instrument which is operated by motions such as beats and depressions. A musical instrument of a guitar type comprises a fingerboard having a plurality of rows of pitch tracks and is usually played by performing depression operations at the same time or selectively on these pitch tracks. This instrument of a guitar type is extremely different from the instrument of a keyboard type not only in construction but also in performance mode. It will be understood that the techniques employed in the instrument of a keyboard type (as described in U.S. Pat. No. 4,217,804), as they are, are not easily applied to the instrument of a guitar type.

In the field of the electronic stringed instrument, techniques have not been developed adequately for assisting, supporting or helping players who have not been well experienced in playing a stringed instrument. In the instrument disclosed in U.S. Pat. No. 4,295,402, even when code-designating operation has been performed partially in error on a fingerboard, appropriate code data are obtained and accompaniment sounds are automatically generated on the basis of the appropriate code data. The technical essence of the invention U.S. Pat. No. 4,295,402 lies in that code designating operation even including error operation produces appropriate code data based upon the electric communication theory relating to signal to noise ratio, and the techniques provides support or assistance for poor or uncertain code designating operation.

High performance techniques in plucking operation with right hand as well as in code designating operation with left hand are required for playing a stringed instrument. There are a variety of plucking-operation modes for example such as (1) down-stroke plucking (hereinafter referred to as "down plucking"), or plucking strings in the direction from a low pitch string to a high pitch string, (2) up-stroke plucking (hereinafter, referred to as "up plucking"), or plucking strings in the direction from a high pitch string to a low pitch string, (3) alternate stroke plucking (hereinafter, referred to as "alternate plucking"), or alternate plucking operation of the down plucking and the up plucking, (4) arpeggio plucking, or plucking particular strings in particular order for dispersed chords, (5) Carter Family plucking and (6) chopper base plucking. It is hard to precisely and firmly perform plucking operations, selecting them from a large variety of these plucking operations during performance of a musical piece.

It is expected by guitar players and, in particular, beginner players that musical tones are obtained by performing only fingering operation on a fingerboard without worrying about complicated plucking operation of strings, which musical tones are similar to those produced when a guitar is played in a normal manner. This means that, to make beginner players advance in playing a guitar in a relatively short time, it is preferable to make the beginner player to pay attention only to fingering operation on a fingerboard by giving help with plucking operation. So it has been long expected a development of an instrument for giving help with plucking operation of stringed instruments.

Advanced performance techniques are required to pluck strings at desired timings and to add accents to the plucking operation. Therefore, it is useful for beginner players to learn timings of plucking operations and how to add accents during the plucking operation, by actually listening to plucking sounds generated by plucking operation performed by a model player. Consequently, it has been expected a development of an instrument which is capable of storing with a high fidelity the state of plucking operation performed by a model player and an instrument which is capable of reproducing with a high fidelity plucking sounds from plucking data obtained by plucking operation performed by a model player.

It is effective for a beginner player to learn how precisely he has performed plucking operations and to immediately find his erroneous plucking operations, so as to make progress in playing techniques of a stringed instrument in a short time. Therefore, it has been waited by beginner players a development of an instrument which is capable of storing with a high fidelity the state of their own plucking operation and an instrument which is capable of reproducing with a high fidelity plucking sounds from the plucking data obtained by his own plucking operation.

Further, in order to learn patterns for a variety of plucking operations and to form patterns other than those of conventional plucking operations, it is necessary for players to store pattern of plucking operations with a simple input manipulation without any restriction. Therefore, it has been expected a development of an instrument which is capable of storing patterns for a variety of plucking operations with a simple input manipulation without any restriction.

SUMMARY OF THE INVENTION

The present invention has been developed on the background mentioned above. An object of the present invention, therefore is to provide a plucking-sound reproducing instrument which allows a player to designate tone pitches only by careful fingering operation on a fingerboard without performing precise plucking operation, and which is capable of sequentially and automatically producing plucking sounds each having the tone pitch designated by the fingering operation.

Other object of the present invention is to provide a plucking-data memory instrument to which plucking data can be simply and instantly step-inputted without use of special plucking-data input means.

A further object of the present invention is to provide a plucking-data memory instrument to which sound-generation timing data for plucking sounds to be produced can be easily and instantly step-inputted.

Another object of the present invention is to provide a plucking-sound reproducing instrument which is capable of producing automatically plucking sounds in accordance with the plucking data stored in a step manner.

Further object of the present invention is to provide a plucking-sound memory instrument which is capable of storing with a high fidelity plucking data obtained in real time while a performer actually plucks strings.

Still further object of the present invention is to provide a plucking-data reproducing instrument which can be used for acoustically confirming a state of plucking operation actually performed by a model player, thereby allowing a user of the instrument to effectively and acoustically learn a state of fine plucking operation.

A yet further object of the present invention is to provide a plucking-sound reproducing instrument which is used for acoustically confirming a state of plucking operation actually performed by a user of the instrument, thereby allowing the user of the instrument to acoustically confirm whether or not he has precisely performed plucking operation.

A yet another object of the present invention is to provide a plucking-data memory which is capable of storing plucking data in a step manner without any restriction under control of a program, from which plucking data plucking sounds are automatically reproduced.

A further object of the present invention is to provide a plucking-data memory instrument which is capable of storing plucking data in a step manner under control of a program, which plucking data are used to automatically produce a plurality of plucking sounds which are to be sequentially generated.

To achieve the above objects, according to the present invention there is provided a plucking-sound generation instrument comprising: a fingerboard having a plurality of fingering operation tracks; pitch-data output means for outputting pitch data in response to fingering operation performed on any one of positions within a plurality of said fingering operation tracks, said pitch data being produced for every fingering operation track on which said fingering operation is performed and also being corresponding to said position on which said fingering operation is performed; plucking-timing data output means for sequentially outputting plucking-timing data which indicate generation timings for a series of plucking sounds to be sequentially generated for every fingering operation track on which said fingering operation is performed; and instruction means for instructing so as to sequentially generate a plurality of plucking sounds at timings indicated by said plucking-timing data, when said plucking-timing data are output for said respective tracks from said plucking-timing data output means while fingering operation remains performed on any one of positions within said fingering operation tracks.

In the plucking-sound generation instrument according to the present invention, a plurality of plucking sounds each having a particular tone pitch can be sequentially generated at timings indicated by plucking timing data only by performing fingering operation on one of positions within respective fingering-operation tracks without performing plucking operation, said tone pitch corresponds to the operated position. Thus, this instrument allows the player to play a stringed instrument, paying whole attention only to his fingering operation.

Note that the above term "fingering-operation track" means an area on a fingerboard, on which area fingering operation is performed. Accordingly, it makes no matter, whether or not strings are stretched on the track. In case that no string is stretched, it is preferable to provide marks or symbols on the fingerboard for representing the fingering-operation area, but if the fingering-operation area can be recognized, marks and the like are not required to be provided on the fingerboard. It is preferable that "track" consists of a straight track, but curved tracks will do. In addition, there may be provided frets (ridges or marks extending across the fingerboard, disposed at predetermined intervals longitudinally along the fingerboard) on the track, as employed in stringed instruments such as guitars, or no fret may be provided as in such musical instruments as violins.

A pitch-designation switch system, PSW used in embodiments, a resistance-detection system or a system using conductive strings and conductive frets is used as "a pitch-data output means".

To achieve the above objects, according to the present invention there is provided a plucking-sound ' generation instrument comprising: a fingerboard having a plurality of fingering operation tracks; a plurality of strings stretched along said respective fingering operation tracks; pitch data output means for outputting pitch data in response to fingering operation effected on any one of said strings, said pitch data being produced for each string on which fingering operation is effected and being corresponding to the position on which said fingering operation is effected; plucking-timing data output means for sequentially outputting plucking-timing data which indicate generation timings for a series of plucking sounds to be generated for each string; and instruction means for instructing so as to sequentially generate a plurality of plucking sounds at timings indicated by said plucking-timing data, when said plucking-timing data have been outputted from said plucking-timing data output means while fingering operation remains effected on any one of said strings, said plucking sounds each having pitch corresponding to the fingering position on which fingering operation is performed and being produced for each string on which fingering operation is effected.

In the plucking-sound generation instrument, a plurality of plucking sounds can be sequentially generated at timings defined by plucking timing data, only by performing fingering operation on any one of a plurality of strings without performing plucking operation, which plucking sounds each have a pitch corresponding to the position on which the fingering operation is performed. Thus, the instrument allows the player to play a stringed instrument, giving his whole attention only to fingering operation.

To achieve the above objects, according to the present invention there is provided a plucking-sound generation instrument comprising: a fingerboard having a plurality of fingering operation tracks; a plurality of strings stretched along said respective fingering operation tracks; pitch-data output means for outputting pitch data in response to fingering operation effected on any one of said strings, said pitch data being produced for each string on which fingering operation is effected and being corresponding to the position on which said fingering operation is effected; timing-data output means for outputting timing data which are used to generate a plurality of plucking sounds for each string in a predetermined order; instruction means for instructing so as to generate plucking sounds each having relevant pitch in accordance with pitch data which are outputted from said pitch-data output means every time when said timing-data output means outputs said timing data; and setting means for setting time intervals of generation timings for a plurality of said plucking sounds.

According to the present invention, plucking sounds can be generated at time intervals set by a setting means.

To achieve the above objects, according to the present invention there is provided a plucking-data memory instrument for storing plucking data which are used for automatically generating plucking sounds to be generated in response to plucking operation performed on strings, said plucking data memory instrument comprising: at least one string stretched on an instrument body; string vibration detection means capable of detecting vibration of said string at real time; memory means; and writing means for sequentially writing timing data into said memory means at real time, when said string vibration detection means has detected a start of vibration of said string, said timing data being indicating the timing of start of the string vibration.

According to the present invention, plucking data can be written in a memory means every time at least one string is caused to begin to vibrate, which plucking data are used to automatically produce plucking sounds in sequence.

And to achieve the above objects, according to the present invention there is provided a plucking-sound generation instrument comprising: memory means for plucking timing data indicating generation timings for plucking sounds to be sequentially generated; read means for sequentially reading out said plucking timing data stored in said memory means; and instruction means for instructing so as to sequentially generate said plucking sounds at timings indicated by said plucking timing data read out by said read means, said plucking sounds each having a particular pitch.

According to the present invention, plucking sounds can be sequentially produced at every timing which is indicated by plucking-timing data read out from a memory means.

To achieve the above object, according to the present invention there is provided a plucking-data memory instrument comprising: a plurality of strings stretched on an instrument body; string vibration detecting means capable of detecting string vibration of said strings at real time; memory means; and writing means for writing timing data and number data into said memory means at real time, when said string vibration detecting means has detected a start of vibration of said respective strings, said timing data being indicating timing of start of vibration of said respective strings and said number data being corresponding to string number of said string which starts vibration.

According to the present invention, plucking data can be written in a memory means every time a plurality of stretched strings are caused to begin to vibrate, which plucking data are used to automatically generate plucking sounds to be generated for every string in response to plucking operation to each of strings.

According to the present invention, there is provided a plucking-sound generation instrument comprising: memory means for storing plucking timing data and string number data respectively, said plucking timing data indicating generation timings for plucking sounds to be sequentially generated and said string number data corresponding to the number of the string which generates said plucking sound; read means for sequentially reading out said timing data and said string number data stored in said memory means; and instruction means for instructing so as to sequentially generate plucking sounds each having a particular pitch at timings indicated by said timing data read out by said read means, said plucking sounds each corresponding to a particular string indicated by said string number.

According to the present invention, plucking sounds each having a particular tone pitch can be sequentially produced at every timing which is indicated by plucking-timing data read out from a memory means, each of which plucking sounds corresponds to a particular string designated by string-number data read out from the memory means.

To achieve the above objects, according to the present invention there is provided a plucking-data memory instrument comprising: at least one string stretched on an instrument body; string-vibration detecting means capable of detecting vibration of said string at real time; memory means; and writing means for sequentially writing timing data and plucking velocity data into said memory means at real time, every time when said string-vibration detecting means detects a start of vibration of said string, said timing data indicating timing of the start of vibration of said string and said plucking velocity data indicating amplitude of string vibration at the time when said string starts vibration or thereafter.

According to the present invention, timing data and plucking-velocity data can be sequentially written in a memory means every time a string-vibration detecting means detects start of vibration of string, each of which timing data represents a timing of start of string vibration, and each of which plucking-velocity data represents an amplitude of vibration which is caused at the start of string vibration or thereafter.

To achieve the above objects, according to the present invention there is provided a plucking-sound generation instrument comprising: memory means for storing plucking-timing data and plucking-velocity data, said plucking-timing data indicating generation timings for plucking sounds to be sequentially generated and said plucking-velocity data indicating sound volume of said plucking sounds; reading means for sequentially reading out said timing data and said plucking-velocity data stored in said memory means; and instruction means for instructing so as to sequentially generate plucking sounds at timings indicated by said timing data read out by said reading means, said plucking sounds having sound volume corresponding to said plucking-velocity data.

According to the present invention, plucking sounds can be sequentially produced at every timing indicated by timing data read out from a memory means, each of which plucking sounds has sound volume corresponding to plucking-velocity data read out from the memory means.

To achieve the above objects, according to the present invention there is provided a plucking-data memory instrument comprising: detecting means for detecting positions indicating generation timings of plucking sounds to be generated; memory means; and writing means for writing plucking data into said memory means, when said detecting means has detected particular positions, said plucking data relating to generation timings for said plucking sounds corresponding to said particular positions detected by said detecting means.

According to the present invention, when a particular position has been detected by a detecting means, plucking data can be written responding thereto in a memory means, which plucking data relates to generation timing of plucking sound corresponding to the above particular position.

To achieve the above objects, according to the present invention there is provided a plucking-data memory instrument comprising: detecting means for detecting positions indicating generation timings for a group of plucking sounds to be sequentially generated at predetermined time intervals; memory means; and writing means for writing plucking-timing data into said memory means, when said detecting means has detected particular positions, said plucking-timing data indicating generation timings for a group of said plucking sounds corresponding to said particular positions.

According to the present invention, every time when a particular position is detected by a detecting means, plucking-timing data can be written responding thereto in a memory means, which data relates to generation timing of a plurality of plucking sounds each corresponding to the above particular position.

To achieve the above object, according to the present invention there is provided a plucking-data memory instrument comprising: at least one stretched string; string-vibration detecting means for detecting vibration of said string; detection means for detecting positions indicating generation timings for a group of plucking sounds to be sequentially generated at predetermined time intervals; memory means; and writing means for writing plucking-timing data into said memory means when said string-vibration detecting means detects string vibration while said detection means has detected particular positions, said plucking-timing data relating to generation timings corresponding to said particular positions detected by said detection means.

According to the present invention, in case that string vibration is detected by a string-vibration detecting means while a particular position has been detected by a detection means, plucking-timing data can be written responding thereto in a memory means, which plucking-timing data relates to generation timing of a plurality of plucking sounds each corresponding to be detected position.

To achieve the above objects, according to the present invention there is provided a plucking-data memory instrument comprising: at least one stretched string; string-vibration detecting means for detecting vibration of said string; detection means for detecting positions indicating generation timings for a group of plucking sound to be sequentially generated at predetermined time intervals; memory means; and writing means for writing plucking-timing data and number data into said memory means, respectively when said string-vibration detecting means detects string vibration while said detection means has detected particular positions, said plucking-timing data relating to generation timings corresponding to said particular positions detected by said detection means, and number data indicating a plurality of string numbers corresponding to said group of plucking sounds to be generated at said timings.

According to the present invention, in case that string vibration is detected by a string-vibration detecting means while a particular position has been detected by a detection means, plucking-timing data and number data can be written responding thereto in a memory means, which plucking-timing data relates to generation timing of a plurality of plucking sounds each corresponding to the detected position and which number data represents string numbers corresponding to a plurality of plucking sounds to be generated.

BRIEF DESCRIPTION OF THE DRAWINGS

FIGS. 1A through 15 are views effective for describing an embodiment of the present invention, which is applied to an electronic stringed instrument, in which:

FIG. 1A is a plan view showing a whole construction of an electronic stringed instrument to which the present invention is applied;

FIG. 2 is a view showing the structure of a plucking display section provided on a string;

FIG. 3 is a block diagram of a preferred embodiment of the present invention;

FIG. 4B is a table indicating a relationship between fret positions and fret numbers;

FIG. 6E is a view showing memory contents of plucking data which are input at real time and are stored on RAM card 17;

FIG. 7 is a flow chart showing a process for discriminating plucking modes during a writing process of step-input data;

FIG. 9 is a view illustrating a relationship between step-input timings and fret positions;

FIG. 10 is a flow chart showing a process to be effected when fingering operation is performed during an automatic plucking performance;

FIG. 11 is a flow chart showing a process to be effected when auto-plucking sounds are reproduced on the basis of plucking data stored at real time;

FIG. 12 is a flow chart showing a process to be effected when fingering operation is performed during reading out of plucking data stored at real time;

FIG. 13 is a flow chart showing a reproducing operation of auto-plucking sounds in accordance with plucking data stored in a step manner;

FIG. 14 is a plan view of an electronic stringed instrument showing another embodiment of the present invention; and FIG. 15 is a flow chart showing a process for generating pitch data by using ultrasonic wave signals.

DETAILED DESCRIPTION OF THE PREFERRED EMBODIMENTS

Figure 1A:
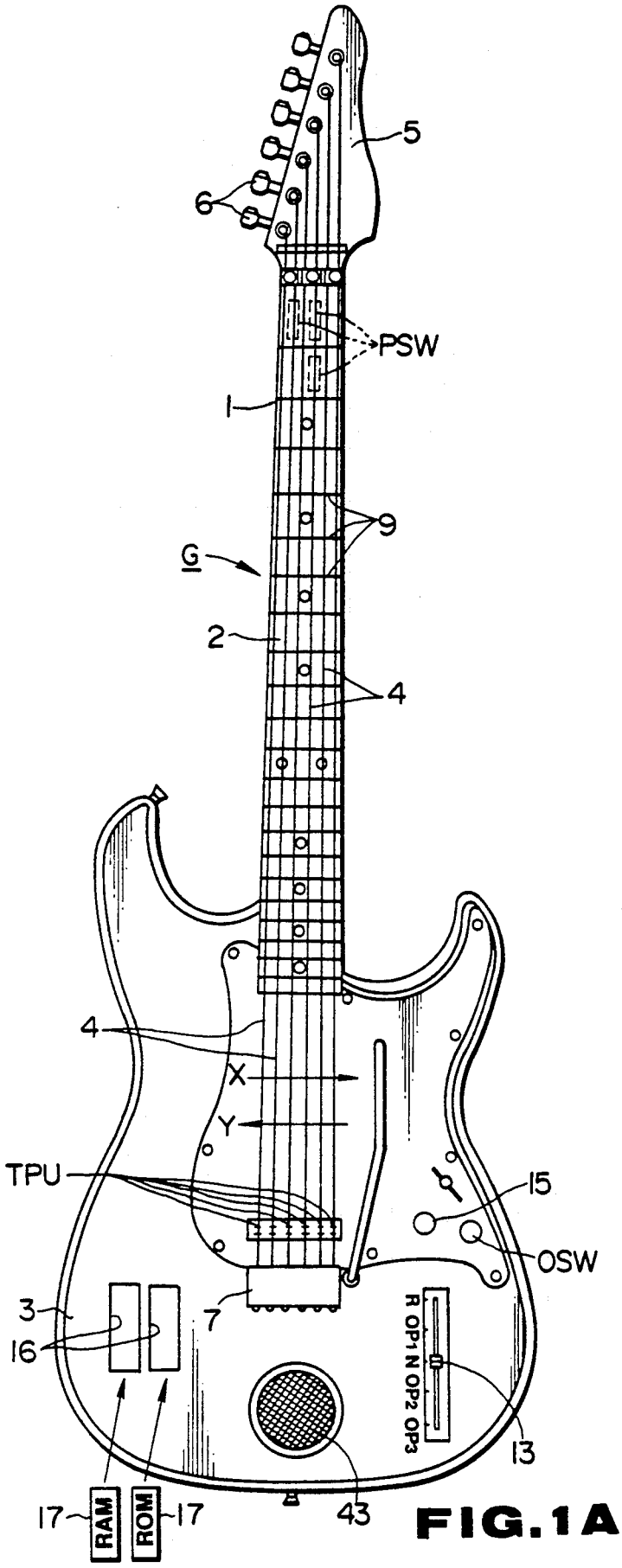

Now, an embodiment in which the present invention has been applied to an electronic stringed instrument will be described in detail with reference to the accompanying drawings.

Construction

FIG. 1 is a plan view showing an electronic stringed instrument according to the present invention.

The stringed instrument G consists of a neck 1 having a fingerboard 2 and a body 3. Six strings 4 to be plucked are stretched along the fingerboard 2 which guides fingers to desired fret positions at the time of fingering.

Strings 4 each have one end adjustably secured to a peg 6 provided on a head 5 of the fingerboard 2 and the other end secured to a bridge 7 provided on an upper surface portion of the body 3, in the vicinity of which portion the fingerboard 2 is fixed to the body 3. A number of frets 9 are provided at predetermined intervals on the fingerboard 2. Pitch designation switches PSW are buried in the fingerboard 2 at portions between adjacent frets 9, facing to each individual string 4. In this instrument, 22 (number of spaces between adjacent frets 9) by 6(number of strings 4), i.e., 132, pitch designation switches are provided.

Figures 2, 4B:
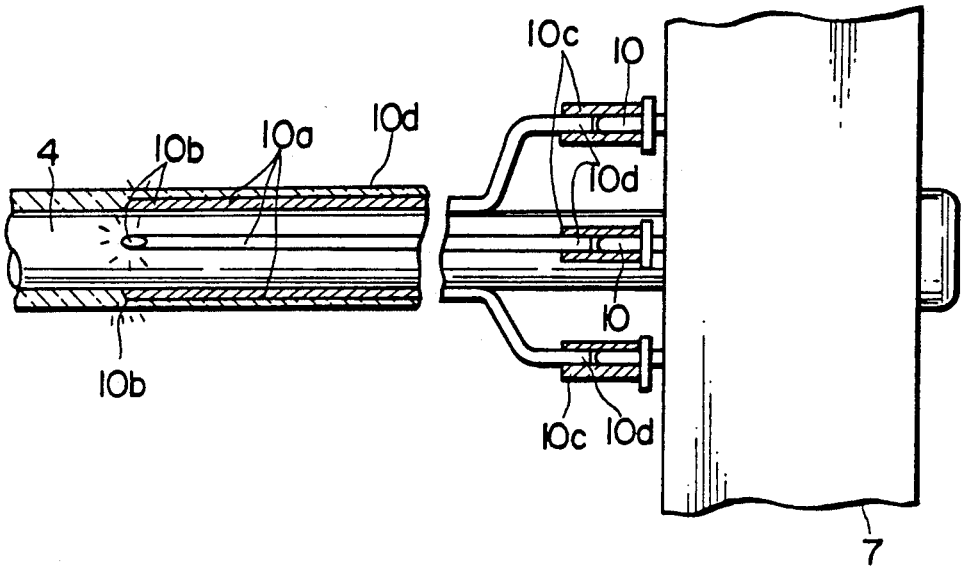

As shown in FIG. 2, a plurality of optical fibers 10*a* are provided around a peripheral surface of the string 4 stretched over the body 3 and are disposed longitudinally extending along the string 4. The strings 4 are arranged such that a player of the instrument can confirm easily and visually which one of strings 4 is to be plucked. LEDs (light emitting diode) 10 which indicate which string 4 is to be plucked are provided, each in the vicinity of one end 10*d* (bridge 7 side) of each optical fiber 10*a*. The other end 10*b* of each optical fiber 10*a* is cut diagonally. Turning-on light of LEDs 10 travels along the optical fibers 10*a* and is emitted from the diagonal section formed at the above mentioned other end 10*b* of the optical fiber 10*a*. A cylindrical shield 10*c* is integrally provided on the one end of each optical fiber 10*a* to shield light emission from LED 10. The string 4 and each optical fiber 10*a* are covered with a transparent tube 10*d* of synthetic resin (e.g., nylon resin).

In the present embodiment, four optical fibers 10*a* and four LEDs 10 are provided on one string 4 but number of these optical fibers 10*a* and LEDs 10 may be properly selected.

Six units of magnetic pick-ups TPU are combined, each with the one end (body 3 side) of each string 4.

The body 3 is provided with a mode switch 13, a power switch 14, a tempo knob 15, a card setting section 16 and an auto-plucking start/stop switch OSW.

The mode switch 13 is used for switching the play mode of the electronic stringed instrument to a recording mode R, a normal mode N, a first auto-plucking play mode $OP_1$, a second auto-plucking play mode $OP_2$ and a third auto-plucking play mode $OP_3$.

The recording mode is set for recording plucking-data on RAM card. The normal mode N is set for playing the instrument, i.e., playing the stringed instrument with the left hand designating pitches and the right hand plucking strings 4. The first to third auto-plucking play modes are set, as will be described later, for obtaining automatic play effected on the basis of plucking data which have been stored on ROM/RAM card and for obtaining automatic play effected on the basis of plucking data which the performer inputs to store on ROM/-RAM card in real time or in step fashion.

The power switch 14 is for turning on/off the power source. The tempo knob 15 is operated for selecting the tempo of automatic play in the first to third auto-plucking play modes. In the card setting section 16, ROM/-RAM card 17 is set, on which card plucking data have been stored or on which card plucking data inputted by the performer have been stored in real time, or in step fashion. The above mentioned ROM/RAM card 17 is detachably set in the card setting section 16.

Constitution of Entire Circuit

Figure 3:
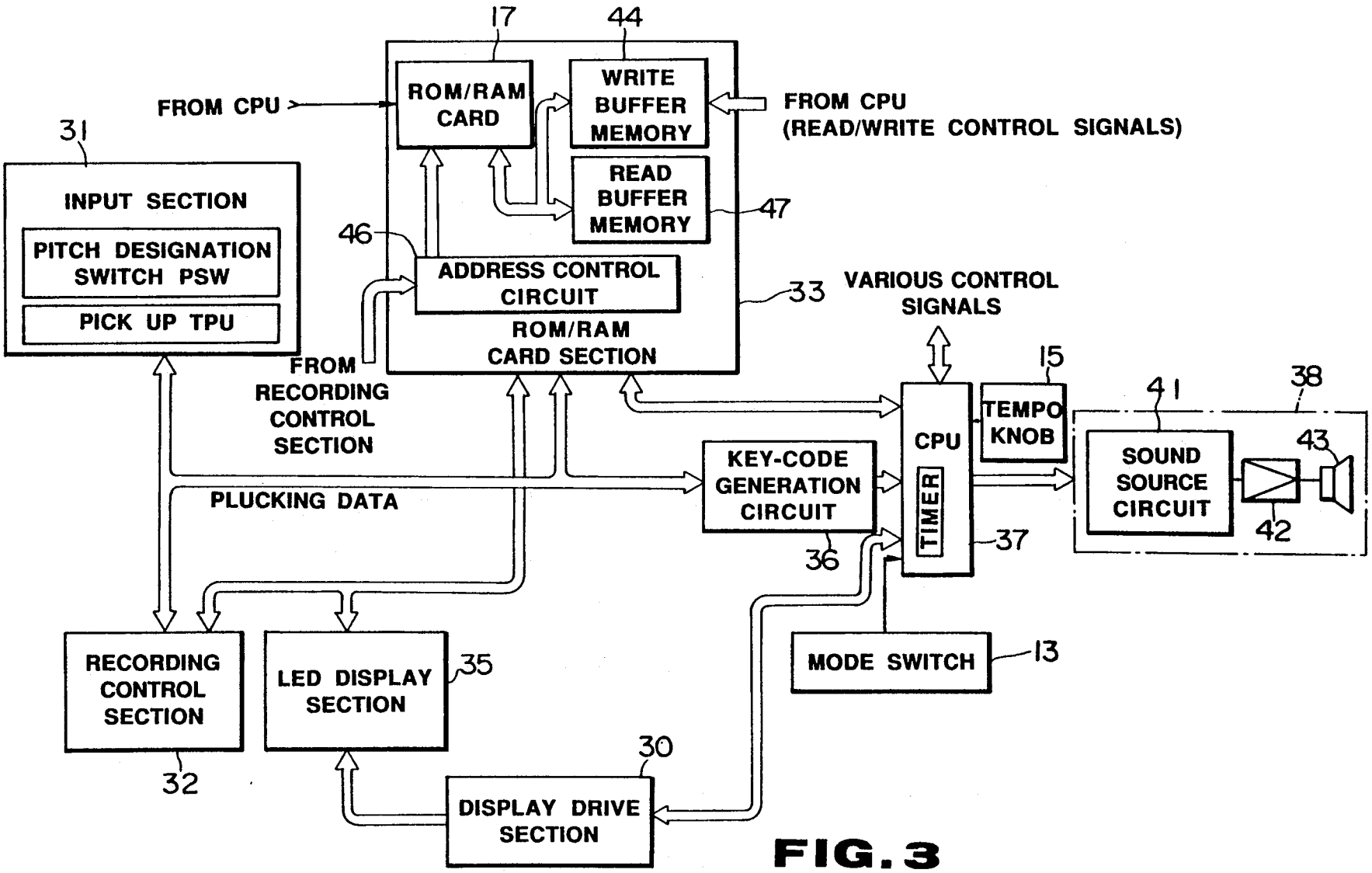

FIG. 3 is a block diagram showing the circuit construction of the electronic stringed instrument according to the present invention. Like reference symbols as those in FIG. 1 represent elements having like function. Input section 31 consists of pitch designation switches PSW and six magnetic pick-ups TPU. The pitch-designation switch PSW produces a pitch-designation signal for designating a pitch of the musical tone to be generated and a tone-generation timing-designation signal for the musical tone to be generated. The magnetic pick-up TPU produces a musical-tone trigger signal TS. In the normal mode, performance information comprises pitch-designation signals FC and musical-tone trigger signals TS, both of which have been delivered from the input section 31. In the recording mode, data depending on the above musical-tone trigger signal TS are written in the form of plucking data (data indicating string-number, plucking strength, plucking-time) as will be described later in ROM/RAM card 17 contained in a ROM/RAM card section 33 under write control of a recording control section 32. The ROM/RAM card serves as plucking-data memory means. In this case, write address data are supplied from the recording control section 32 to the ROM/RAM card section 33.

In the normal mode N, the performance information supplied from the input section 31 is converted through a key-code generation circuit 36 into corresponding key code. The key code thus generated is supplied through CPU 37 to a sound-source circuit block 38, which generates a corresponding musical tone to be generated. In the first to third auto-plucking play modes $OP_1$ to $OP_2$, the plucking data read out from ROM/RAM card 17 of the ROM/RAM card section 33 is supplied through CPU 37 to the sound-source circuit block 38. Musical tones relating plucking sounds are generated and outputted in sequence through an amplifier 42 and a speaker 43 in accordance with the plucking data. In accordance with the selected modes, a luminous display drive section 30 drives LEDs 10 of a LED display section 35 on the basis of control signals supplied from CPU 37.

Constitution of Input Section 31

Figure 4A:
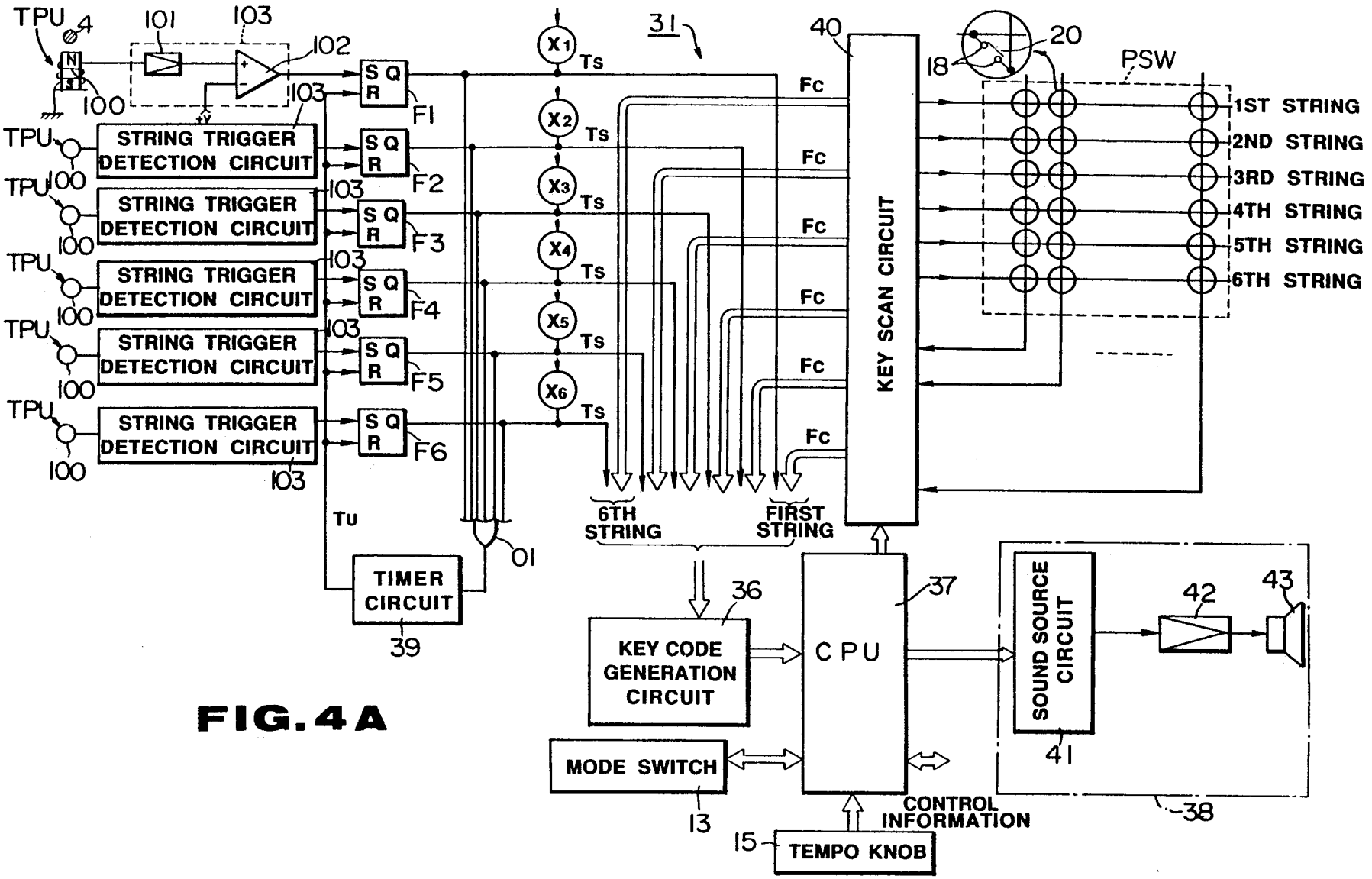
FIG. 4A is a block diagram showing a whole circuit construction including a detailed input section.

FIG. 4A is a specific construction of the input section 31.

The input section 31 consists of trigger pick-ups TPU and pitch-designation switches PSW. The trigger pick-up TPU is independently provided for each string 4. The trigger pick-up TPU converts mechanical vibration of string 4 caused by plucking into electro motive force generated by change in a magnetic field of a magnet 100 and picks up the electro motive force. The pick-up signals are supplied as set (S) signals to flip-flops of RS type $F_1$ through $F_6$ through string-trigger detection circuits 103 consisting of an amplifier 101 and a comparator amplifier 102. Q-outputs of these flip-flops $F_1$ through $F_6$ are supplied as musical-tone trigger signals TS to CPU 37. The Q-output of each of flip-flops $F_1$ through $F_6$ is provided through OR gate 01 to a timer circuit 39 as a driving start signal to start driving of the timer circuit 39. A time-up signal TU generated by the timer circuit 39 after time counting is supplied as a reset (R) signal to each of flip-flops $F_1$ through $F_6$. Thus, trigger signals TS generated by the trigger pick-ups TPU to flip-flops $F_1$ through $F_2$ are sampled every timer time. This sampling operation is made in order to generate one musical tone trigger signal TS for one plucking operation on strings 4, even though the trigger pick-up TPU generates trigger signals for several times for one plucking operation on strings 4. Therefore, even if other trigger signal TS following the first trigger signal TS is supplied to each of flip-flops $F_1$ through $F_2$ during time counting of the timer circuit 39 and as the result two driving start signals are continuously supplied to the timer circuit 39, the timer circuit 39 is allowed to continue its counting operation. Thus, the second trigger signal TS is dealt with as an ineffective trigger signal. The third trigger signal TS supplied from the same trigger pick-up TPU after completion of time counting of the timer circuit 39 is processed as an effective musical-tone trigger signal TS. In this manner, it is guaranteed that when one plucking operation is executed, the first trigger signal is supplied to CPU 37 as an effective musical-tone trigger signal.

Meanwhile, in the normal mode N, "on" signal of each pitch-designation switch PSW is detected as a pitch designation signal FC in accordance with a key-sampling signal supplied from a key-scan circuit 40 controlled by CPU 37. The pitch-designation signal FC is provided as a fret number from the key scan circuit 40. This fret number is expressed as 5-bit digital data, as shown in FIG. 4B. The fret number is assigned values from "0000" (indicating an open string fret position) to "10110" (indicating the 22nd fret position) for digitally expressing each fret position from the open string fret position to the 22nd fret position.

In the recording mode R, when a plucking recording by step inputting is executed, "on" signal of each pitch-designation switch PSW is stored in the ROM/RAM card section 17 as sound-generation timing data of plucking sounds, as to be described later.

Construction of Musical-Tone Generation Section

The musical tone generation section 38 consists of the sound source circuit 41, the amplifier 42 and the speaker 43, as shown in FIG. 3. The sound source circuit 41 generates musical-tone signals having corresponding pitches in accordance with the key code data or plucking data read out from the ROM/RAM card section 33. The amplifier 42 serves to amplify the musical-tone signals supplied from the sound source circuit and outputs sounds through the speaker 43.

In the normal mode N, the musical-tone trigger signals TS and pitch-designation signals FC indicating fret number are supplied from the input section 31 to the key-code generation circuit 36. The key-code generation circuit 36 converts the fret number into corresponding key code every time the musical-tone trigger signal TS is inputted thereto. The key code is supplied through CPU 37 to the sound source circuit 41, which generates a musical tone signal corresponding to the key code. The musical tone signal is outputted through the amplifier 42 and the speaker 43.

The state of operation of the mode switch 13 and the tempo knob 15 is detected by CPU 37. The result of detection is provided from CPU 37 as control information for controlling automatic sound generation of plucking data in the first to third play modes $OP_1$ to $OP_3$. The ROM/RAM card section 33 includes the ROM/RAM card 17, an address control circuit 46, a write buffer memory 44 and a read buffer memory 47, as shown in FIG. 3. The address control circuit 46 serves to control an operation of reading out plucking data from ROM/RAM card 17. The ROM/RAM card 17 is used in the recording mode R, and in the first to third auto-plucking play modes $OP_1$ to $OP_3$.

Figure 5A:
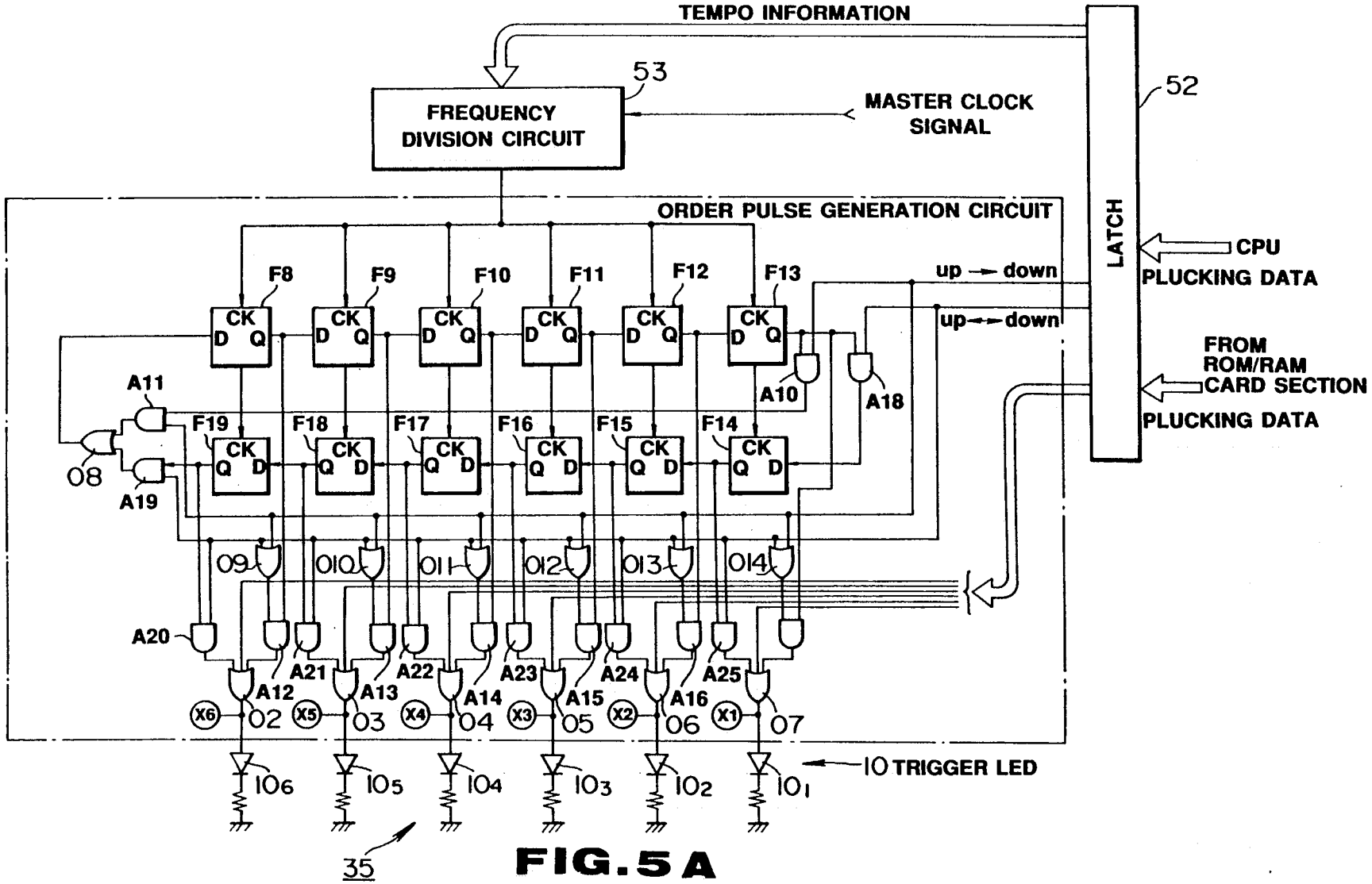
FIG. 5A is a circuit diagram showing a generation section for generating tone-trigger signals and a LED section.

Constitution of Musical-Tone Trigger-Signal Generation Section.LED Display Section 35 When Arpeggio Plucking Operation FIG. 5A is a view showing a specific constitution of a musical-tone trigger-signal generation section.LED display section 35.

The string-number data in the plucking data read out from the ROM/RAM card section 33 is once latched at a latch 52 to be decoded into 3-bit data for respective six strings 4. Respective bit data of arpeggio plucking of strings 4 are sequentially supplied from $X_1$ to $X_2$ terminals through OR gates 02 to 07 to $X_1$ to $X_2$ terminals (Q-output terminals of flip-flops $F_1$ to $F_6$) of FIG. 4A, and then sent as musical-tone trigger signal TS through CPU 37 to the sound source circuit 41. The respective bit data are selectively supplied to the plucking-display LEDs 10 ($10_1$ through $10_6$) to turn on the corresponding LEDs 10. The diagnal section of the optical fiber 10*a* provided on the string 4 corresponding to the turned-on LED 10 is lightened. For example, in case when string-number data indicating an arpeggio are read out, plucking sounds are sequentially outputted as arpeggio sounds from the sound source circuit 41 through the line as constituted mentioned above. And at the same time, the LEDs 10 and the certain portion of the optical fibers 10*a*, provided on the corresponding strings 4 are turned on in the order of the arpeggio.

When Down-Plucking Operation

When plucking data read out from the ROM/RAM card section 33 is down-plucking data, the plucking data is supplied as an enable signal from the latch 52 through AND gates A10, A11 and OR gates 09 to 014 to AND gates A12 to A17. In consequence, a six-stage circulation counter of a closed loop type is formed with AND gates A10, A11, OR gate 08 and D-type flip-flops $F_8$ to $F_{13}$. Q-outputs sequentially provided from the flip-flops $F_8$ to $F_{13}$ are sequentially supplied to $X_1$ to $X_2$ terminals of FIG. 4 through the AND gates A12 to A17 and the OR gates 02 to 07. Thus, the Q-outputs are sequentially supplied as musical-tone trigger signals TS to the sound source circuit 41 as well as to LEDs 10. As the result, down-plucking sounds representing down-plucking in X-direction shown in FIG. 1A are generated in sequence and at the same time the LEDs 10 are turned on.

When Alternate Plucking Operation

In case of alternate plucking data comprising down-plucking data and up-plucking data, both of which data occur repeatedly and alternately, the alternate plucking data is supplied as an enable signal from the latch 52 through OR gates 09 to 014 to AND gates A12 to A17 and AND gates A18 to A25. Thus, a 12-stage circulation counter of a closed loop type is formed with AND gates A18, D-type flip-flops $F_{14}$ to $F_{19}$, AND gate A19, OR gate 08 and the flip-flops $F_8$ to $F_{13}$. The Q-output of each of flip-flops $F_8$ to $F_{13}$ is supplied as musical-tone trigger signal TS through AND gates A12 to A17, and OR gates 02 to 07 to $X_1$ through $X_6$ terminals of FIG. 4 and also to LEDs 10. Thus, sounds are first generated representing downward (x-direction of FIG. 1A) plucking and LEDs are turned on therewith. The Q-outputs of flip-flops $F_{14}$ to $F_{19}$ are supplied through the AND gates A20 to A25, OR gates 02 to 07 to $X_1$ through $X_6$ terminals of FIG. 4 and also to LEDs 12. Then, sounds representing upward (in Y direction shown in FIG. 1A) plucking operation are generated and LEDs are turned on therewith. As the result, sound generation and LED indication representing the downward direction plucking operation, and those representing the upward direction plucking operation are alternatively repeated. In this way, alternate plucking performance is displayed.

CPU 37 sets once at the latch 52 tempo information obtained by setting of the tempo knob 15 and then supplies it to a frequency division circuit 53. Accordingly, the frequency division circuit 53 determines frequency division of a master clock signal supplied from CPU 37. The frequency divided clock signal is provided as a shift clock signal to D-type flip-flops $F_8$ to $F_{19}$. For this reason, the plucking data are read out and certain portions of strings 4 corresponding to LEDs 10 are sequentially lightened at the tempo corresponding to the output timing of the shift clock signal. Thus, the timing difference between the generation timing of the previous alternate plucking sounds and that of the current alternate plucking sounds is determined in accordance with the tempo set by operation of the tempo knob 15.

When Up-Pluking Operation

Specific constitution for an automatic sound generation of plucking sounds and display thereof in an up-plucking operation is not shown in the present embodiment. In case of the up-plucking operation, flip-flops $F_{14}$ through $F_{19}$ may be arranged in the same constitution as but be of the opposite polarity to flip-flops $F_8$ through $F_{13}$. In this case, at the time of alternate plucking, flip-flops $F_{14}$ through $F_{19}$ and flip-flops $F_8$ through $F_{13}$ may be arranged in a single closed loop.

Constitution of Recording Control Section 32

Figure 5B:
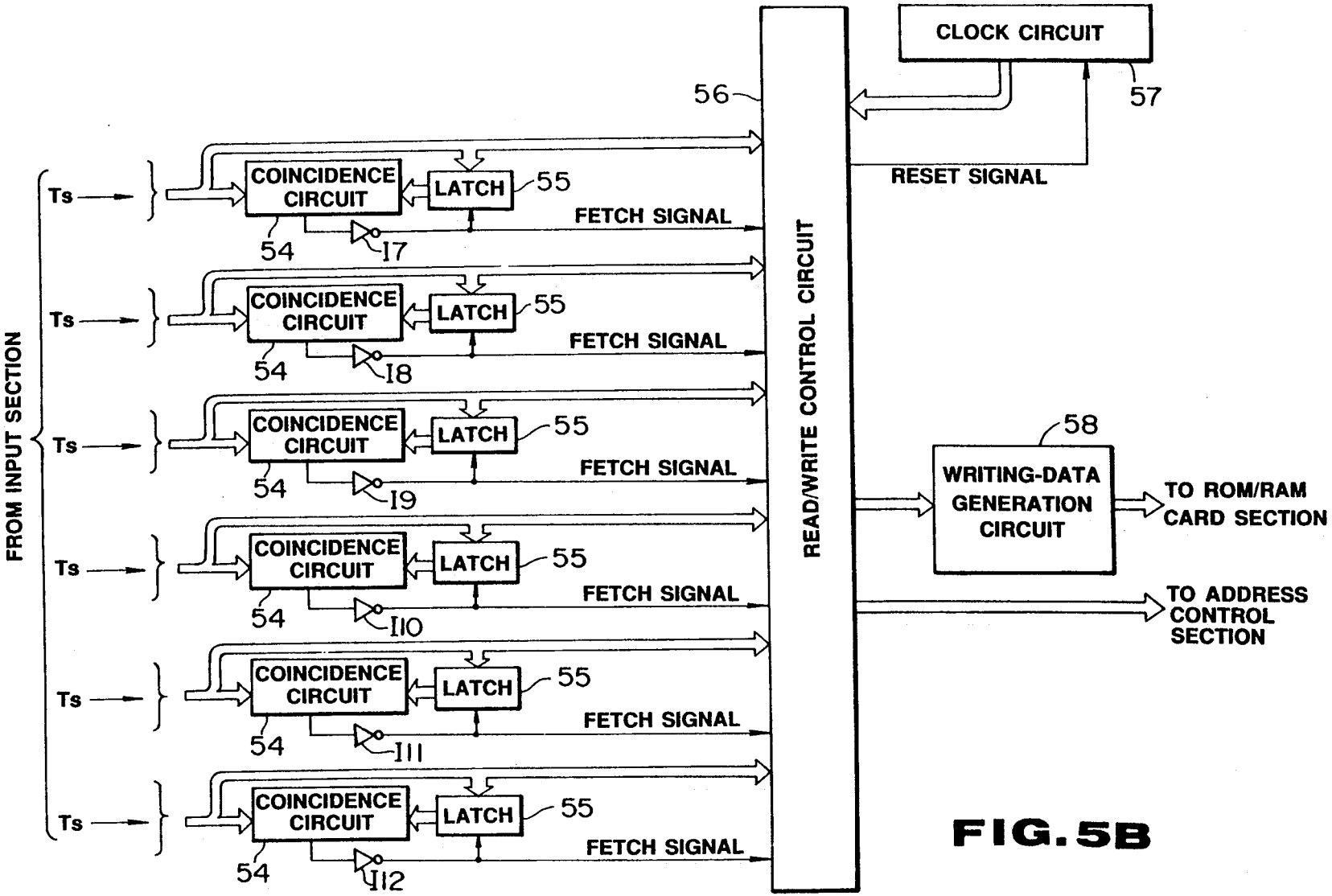
FIG. 5B is a circuit diagram showing a recording control section.

FIG. 5B is a view showing a specific constitution of the recording control section 32. Trigger signal TS of respective strings delivered from the input section 31 is supplied to a coincidence circuit 54 provided for respective strings and is latched at respective latches 55 before being supplied to the coincidence circuit 54. Each coincidence circuit 54 compares the contents of the current plucking data delivered from the input section 31, i.e., the trigger signal TS and the contents of the previous plucking data delivered from the latch 55, i.e., the trigger signal TS. If it is discriminated that the contents of two plucking data coincide to each other without any change, the coincidence circuits 54 output coincidence signals (high level signals), which are inverted by inverters $I_7$ to $I_{12}$. When contents of the current plucking data is different from those of previous plucking data, for example, when other string 4 is plucked, the coincidence circuits 54 output non-coincidence signals (low level signals), which are inverted by inverters $I_7$ through $I_{12}$. The inverted output signals are supplied as latch signals to latches 55 and are also supplied as take-in signals to read/write control circuit 56. Upon receipt of the take-in signals, the read/write control circuit 56 takes in the trigger signals TS representing contents of the current plucking data.

A clock circuit 57 counts the time interval (t) between the time at which the contents of the previous plucking data have changed and the time at which the contents of the current plucking data are changed. The counted time interval (t) is supplied to the read/write control circuit 56 as data representing the time interval of sound-generation-timings, i.e., plucking timing. Therefore, not only tone length but also rest data are supplied to the control circuit 56. The above mentioned plucking data are supplied to a writing-data generation circuit 58. The plucking data supplied to the writing-data generation circuit 58 are written in a predetermined sequence on the ROM/RAM card 17 in the ROM/RAM card section 33. The plucking data are used for automatic generation of plucking sounds in the second and third auto plucking play modes $OP_2$ and $OP_3$. Each plucking data is delivered to the ROM/-RAM card section 33 to be written in a predetermined sequence on the ROM/RAM card 17. In this case, write-address data is supplied from the read/write control circuit 56 to the address control section 46 of the ROM/RAM card section 33.

Operation of Embodiment

Now, operation of the embodiment having the above mentioned construction, which is applied to an electronic stringed instrument, will be described with reference to a processing operation of CPU 37.

Figure 6A:
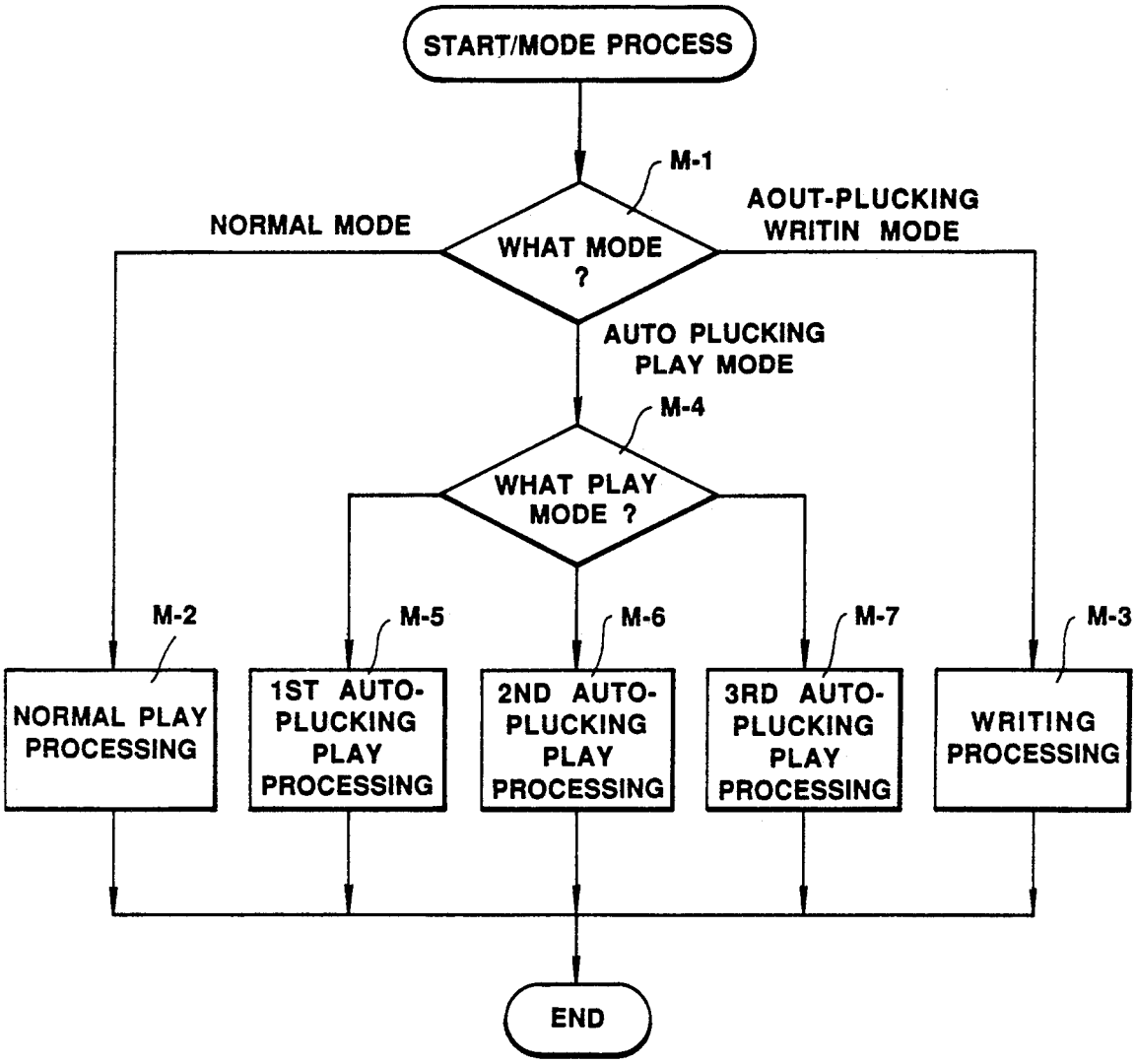
FIG. 6A is a flow chart showing a process for setting modes.

FIG. 6A is a flow chart of a processing of CPU 37 to discriminate which mode is selected by the mode switch 13. This flow starts with discrimination of whether or not the main routine process (not shown) of CPU 37 is time-interrupted, or whether or not CPU 37 repeatedly operates at a predetermined timing.

When a mode-processing starts, it is discriminated which mode is selected by the mode switch 13 (at Step M-1). When the normal mode has been set, the normal-play processing is effected (at Step M-2). When the auto-plucking write mode has been set, plucking-data write processing is executed (at Step M-3). When auto-plucking play mode has been set, it is discriminated which auto-plucking play mode is selected thereafter (at Step M-4). When the first auto-plucking play mode $OP_1$ has been selected, the first auto-plucking play processing is effected (at Step M-5). When the second auto-plucking play mode $OP_2$ has been selected, the second auto-plucking play processing is effected (at Step M-6). And when the third auto-plucking play mode $OP_3$ has been selected, the third auto-plucking play processing is effected. After completion of respective processings, the operation of this flow is terminated.

A. Normal Play Mode

When the mode switch 13 has been set to the normal play mode, a conventional performance of the stringed instrument is executed. Desired tone pitches are designated by pitch-designation operation of the performer to the pitch-designation switch PSW. The sound generation of musical tone having a designated pitch starts in synchronism of output timing of the trigger signal which is picked up by the trigger pick-up TPU in response to the performer's plucking of string 4.

B. Write Mode

When the mode switch 13 has been set to the write mode, the desired plucking data is written on RAM card 17 of ROM/RAM card 17. The writing process comprises a real-time input process in which plucking data (sound-generation timing data, plucking-force data) are recorded at real time in accordance with actual plucking operation, and a step input process in which plucking data are recorded in a step fashion.

a. Real Time Recording

Figure 6B:
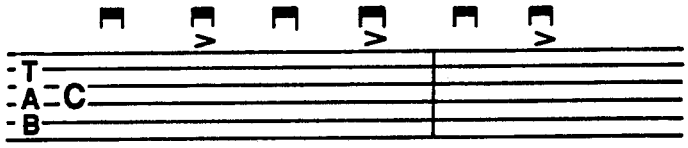
FIG. 6B is a view showing a TAB musical note which indicates contents of plucking performance.
Figure 6D:
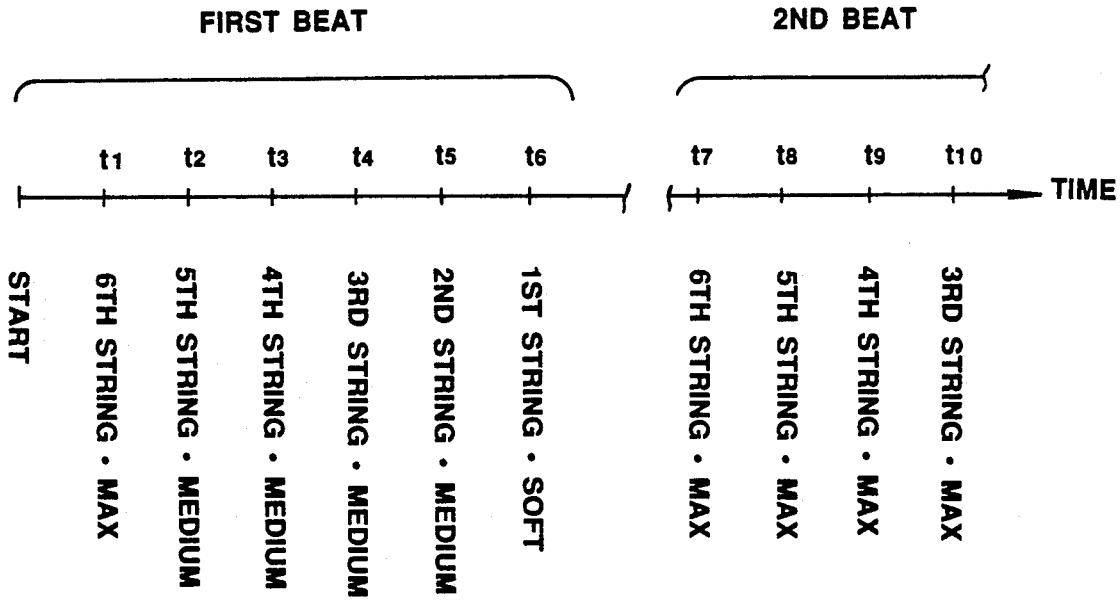
FIG. 6D is a view showing a state of plucking operation.
Figure 6C:
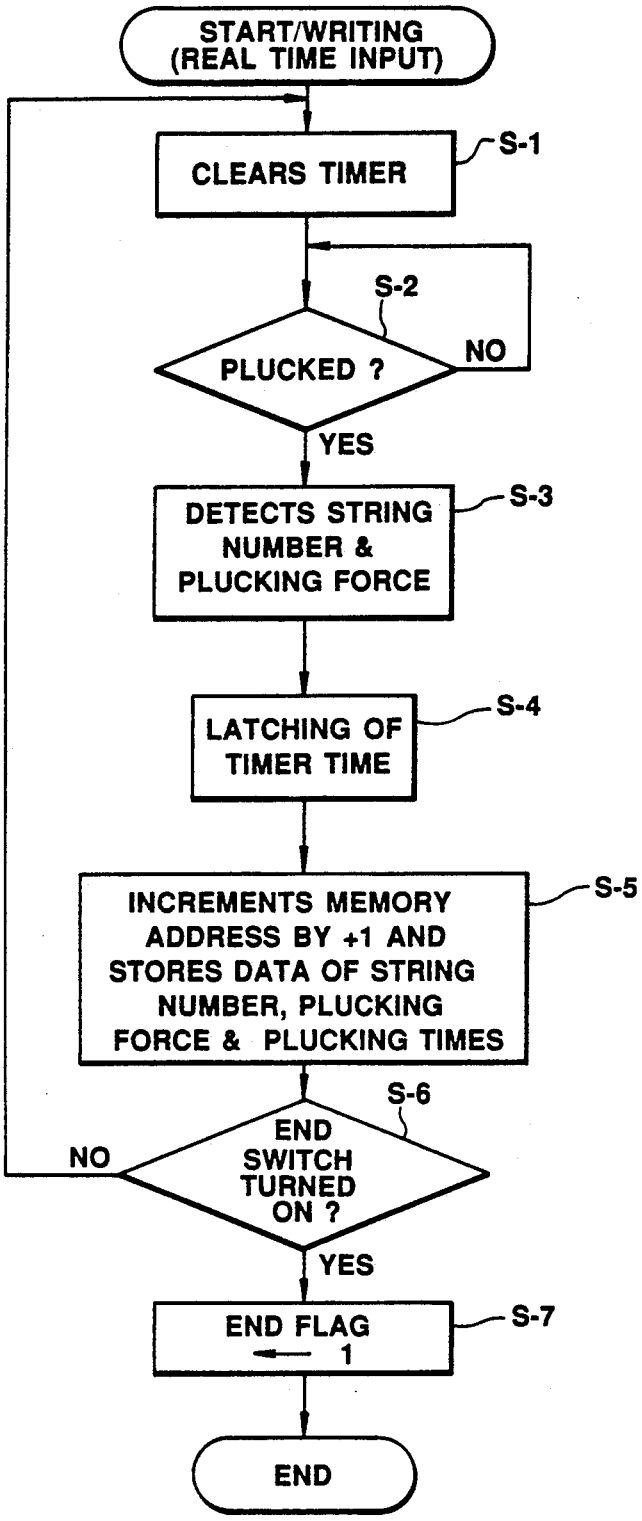
FIG. 6C is a flow chart showing a real time inputting and writing process.

A real-time recording operation will be described, in which down-stroke plucking performance as shown in a TAB musical note of FIG. 6B is actually effected at a predetermined timing (indicated by symbol ⊓) with a predetermined plucking force (indicated by accent <) and the data obtained thereby is recorded at real time. FIG. 6C is a flow chart indicating processing operation of CPU 37. This flow starts with a timer interrupt caused in the main routine operation (not shown) or an operation repeated at a predetermined timing.

In FIG. 6C, after start of writing, the timer is cleared to count sound-generation timing (at Step S-1). Then, it is discriminated whether or not string 4 has been plucked (at Step S-2). When it is discriminated no string is plucked, the processing at Step S-2 is repeated until it is discriminated that a string is plucked. When the result is "YES", the number of the string plucked (string-number of any of the first throngh sixth string) and the plucking force (representing plucking accent) thereof are detected (at Step S-3). The time which the timer indicates at the time is latched to obtain timing data of the plucking operation (at Step S-4). And thereafter, the address in ROM/RAM card 17 is incremented by +1 to store data of string-number, plucking force and plucking-timing on the RAM card 17 (at STep S-5).

Following the above mentioned processing operation, it is discriminated whether or not an end switch (not shown) is turned on to terminate the writing process (at Step S-6). When the result is "NO", the operation returns to the start of writing and the processing operations of Steps S-1 through S-6 are repeated thereafter. When the result is "YES", then the value "1" is raised at an end flag, indicating that the writing operation is terminated, and the flow is terminated.

In this manner, the plucking data obtained when the performer actually plucks the string at his optional timing are stored on the RAM card 17. For example, when the down-stroke plucking performance as indicated in the TAB musical note of 4 by 4 time as shown in FIG. 6B is sequentially effected on the respective strings 4 (the first string to the sixth string) at timing ($t_1$ through $t_6$) and with plucking force (max. through min.), as shown in FIG. 6D, the plucking data having the contents as shown in FIG. 6E are stored at memory areas corresponding to respective memory addresses (1 through 6) in the RAM card 17. That is, FIG. 6E indicates the case in which the down-stroke plucking at the first beat of the first bar of FIG. 6B is effected on the strings 4 in the order from the sixth to the first string at plucking timing ($t_1$ through $t_6$) with plucking forces (max, medium, medium, medium, medium, min.). In this case, plucking data obtained by down-stroke plucking are stored at areas corresponding to memory addresses 1 through 6 in the RAM card 17. The plucking data are stored as one set of data for the down-stroke plucking at the first beat. At the following second beat in FIG. 6B, the down-stroke plucking is instructed to be effected with an accent <. FIG. 6D also indicates the case where the down-stroke plucking performance is sequentially executed on the strings in the order from the sixth string to the first string at the plucking timing $t_7$ through $t_{12}$ with maximum plucking accent. In this case, the down-stroke plucking data having contents as shown in FIG. 6C are stored at the areas corresponding to the memory addresses 7 through 12 in the RAM card 17.

In this write processing, the string number data (the first string through the sixth string) are stored as digital data of 3-bit ·8-stage, as shown in FIG. 6E. The plucking force data are also stored as digital data of 3-bit ·3-stage, as shown in FIG. 6E. The bit number of these data can be appropriately set so as to meet with the memory capacitance of the RAM card 17.

b. Step Recording

An operation of write processing by a step input will be described with reference to an example in which the plucking data as shown in FIG. 6B is stored in a step fashion.

Figure 7:
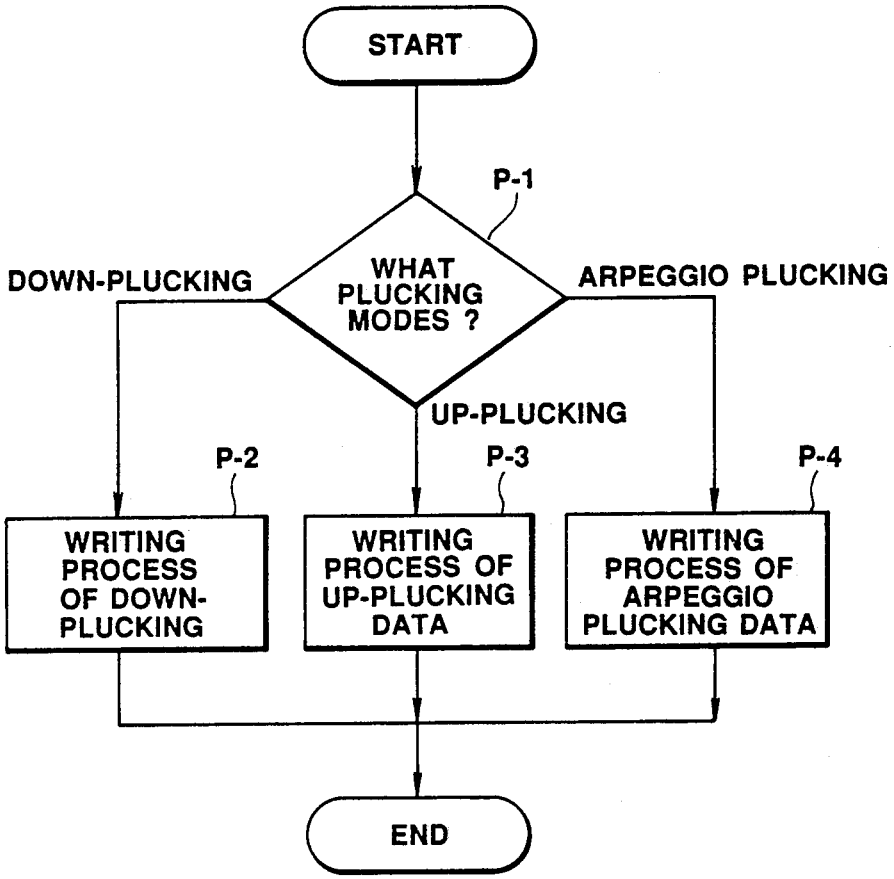

In case of this step input, differing from the case of the real-time inputting, different types of write-processings are effected depending upon the modes of plucking operation. The process of CPU 37 for discriminating modes of plucking operation will be described referring to a flow-chart shown in FIG. 7.

This flow starts with a time-interruption caused in the main routine (not shown) or repeated operation executed at a predetermined timing.

At first, it is discriminated what mode of plucking operation is to be stored (at Step P-2). In case of up-plucking mode, the write-processing is executed for the up-plucking data (at Step P-3). In case of arpeggio plucking mode, the write-processing is executed for the arpeggio plucking data (at Step P-4). After completion of respective write-processings, this flow is terminated.

Figure 8A:
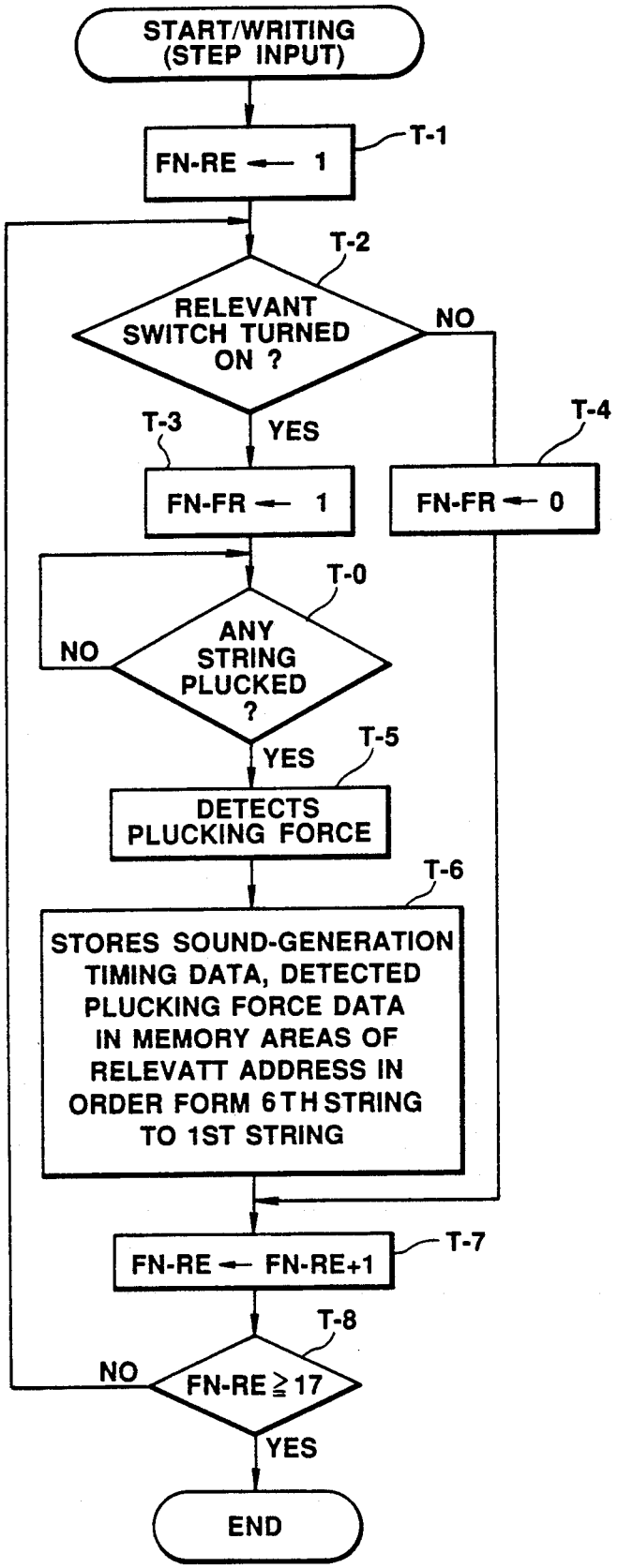
FIG. 8A is a flow chart showing the writing process of step-input data.

FIG. 8A is a flow chart illustrating the processing operation of CPU 37 for the step-write processing of the down-plucking data which is similar to the down-plucking data obtained when the down-plucking is effected, as shown in FIG. 6B. This flow starts with the time-interruption to the main routine (not shown) or repeated operations at a predetermined timing.

Figure 9:
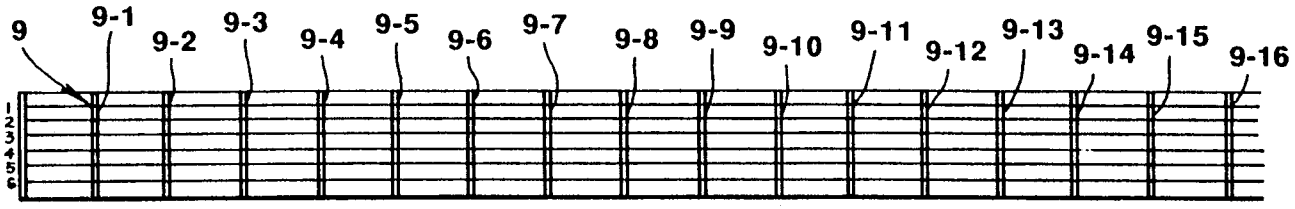

In FIG. 8A, when the write-processing has started, a value "1" representing the first fret is substituted to a relevant fret-number register FN-RE (at Step T-1). It is discriminated whether or not the pitch-designation switch PSW provided at the first fret is turned on to input the data indicating the sound-generation timing position in the step-input (at Step T-2). When the result is "YES", the value "1" is raised at the relevant fret-number flag (at Step T-3). When the result is "NO", the value "0" is given to the relevant fret-number flag (at Step T-4). The flag of "1" or "0" represents that the first fret is turned on or that the first fret is not turned on, respectively. As shown in FIG. 9, the first fret position through the 16th fret position among the first fret through the 22nd fret of the electronic stringed instrument correspond to steps which are obtained by equally dividing one bar into 16 in the musical note shown in FIG. 6B, that is, in case of 4 by 4 beat, each fret position mentioned above corresponds to a 16th note (a semiquaver) as the minimum unit. Depression on the first fret 9 designates a timing (or sound-generation timing) position to be inputted as the first plucking data at the first beat position of the first note in FIG. 6B.

Figure 8B:
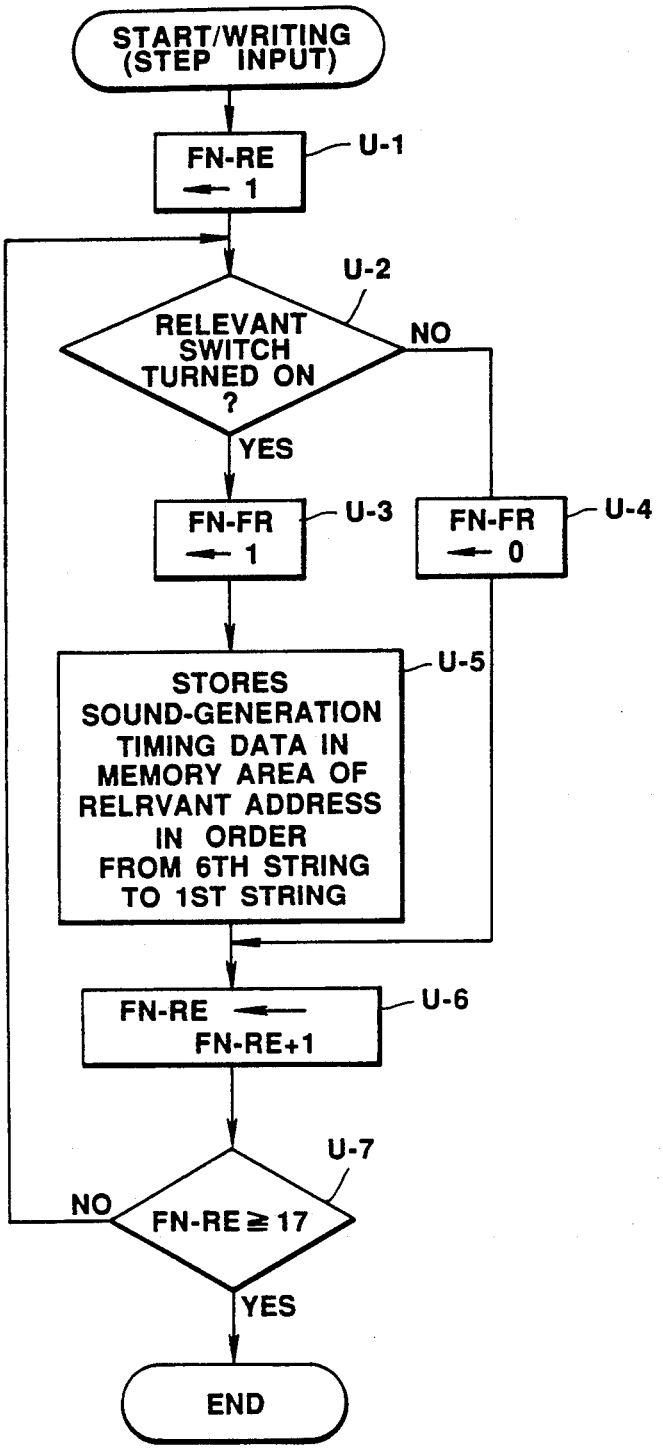
FIG. 8B is a flow chart showing another example of a step-input.

Following Step T-3, it is discriminated whether or not any of the first string through the sixth string has been plucked at Step T-0. When the result is "NO", the processing of Step T-4 is repeated until any of strings 4 is plucked. When the result is "YES", the plucking force (plucking accent) at the time of plucking is detected (at Step T-5). In the present embodiment, thus detected plucking force represents all of plucking forces to all the strings 4, i.e., the sixth string to the first string. As shown in FIG. 8B, however, even if a certain string is not plucked, sound-generation timing data corresponding to a certain switch PSW position may be inputted (at Steps U-5 to U-7) only by turning on operation of the relevant pitch-designation switch PSW (at Steps U-1 through U-4).

Then, predetermined sound-generation timing data corresponding to generation timing 1 shown in FIG. 9 are stored in the order from the sixth string to the first string at memory areas corresponding to memory addresses of RAM card 17 (at Step T-6). These timing data indicate sound-generation timings at which sounds of musical notes corresponding to respective strings, the first string to the sixth string are produced certain time intervals at the first beat, or the data indicates a time-interval of sound-generation timing of each string. In the present embodiment, the sound-generation timing data are automatically stored at the memory areas under the instruction of CPU 37, but the sound-generation timing data may be set in accordance with the program by manual operation of performer. In this manner, as the plucking data at the first beat in the first bar of the musical note shown in FIG. 6B is inputted the plucking data similar to that obtained when all of the strings 4, the sixth string to the first string are plucked with a value "100" representing medium plucking force at the sound-generation timing 1 of FIG. 9A.

Then, data in the relevant fret-number register FN-RE is incremented by 1 (at Step T-8), that is, the data 1 representing the first fret 9-1 is altered to data 2 representing the second fret 9-2 by adding 1 thereto. It is discriminated whether or not the data in the relevant fret-number register FN-RE has become more than 17 (at Step T-8). At present, the data is 2, i.e., $2<17$, so that the result "NO" is discriminated and the processing operation returns to Step T-2. When the result is "YES", all of the plucking data for all of the frets, the first fret 9-1 to the 16th fret 9-16 have been inputted in a step fashion (the plucking data for one bar have been inputted in a step fashion) and this flow of operation is terminated.

After the processing operation of CPU 37 has returned to Step T-2, the processing operation similar to that executed at the first fret position is executed in order to input in a step fashion the plucking data at the memory area corresponding to the second-fret position shown in FIG. 9. The contents of plucking to be recorded represent sound-generation timing corresponding to positions of the second 9-2 to the 4th fret 9-4, as shown in the musical note of FIG. 6B. Since, at the timing 2 to 4 shown in FIG. 9, the plucking data are not required to be inputted in a step fashion, the data in the corresponding fret-number register is incremented to the value 5.

Thereafter, one of the strings 4 is plucked with the maximum plucking force so as to add an accent with the 5th fret being operated "ON", in order to input the plucking data for down plucking at the second beat at the first bar shown in the musical note of FIG. 6B. Then, as similar to the case of the position of timing 1, the predetermined sound-generation data and the data 11 of maximum plucking force data for all of the strings are inputted in a step fashion in the order from the sixth string to the first string at the position of the sound-generation timing 5 corresponding to the position of the fifth fret 9-5 of FIG. 9.

Then, in order to input the plucking data for the third beat at the first bar of FIG. 6B, one of strings 4 is plucked with the position of the ninth fret 9-9 being operated "on". Thereafter, in this manner, one of the strings 4 is plucked with the fret position corresponding to the timing of sound generation being sequentially operated "on", and then the recording of the data sequentially inputted in a step fashion is effected.

Figure 1B:
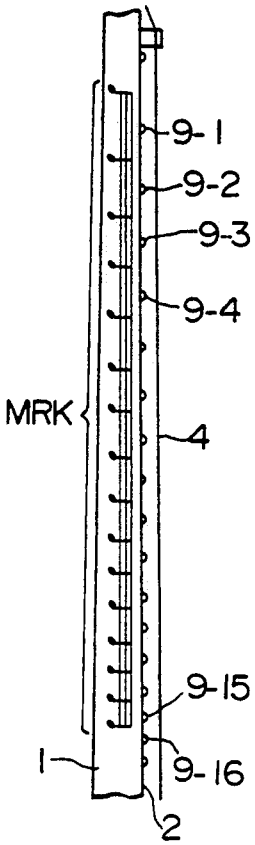
FIG. 1B is a side view from left showing the side of a neck portion of the electronic stringed instrument shown in FIG. 1A.

In the present embodiment, since marks MRK representing positions of the first fret 9-1 through the 16th fret 9-16 are provided on the side surface of the neck 1 of the electronic stringed instrument as shown in FIG. 1B, these marks conveniently indicate the positions of the fret-switch FSW to be turned on, when the plucking data inputted in a step fashion is recorded, thereby serving for an easy step-input operation.

In the above mentioned example, the input operation of the down plucking data for down plucking operation has been described, but the up-plucking data and the arpeggio-plucking data may be inputted in the same way described above.

c. First Auto-Plucking Play Mode

The first auto-plucking play mode $OP_1$ set by operation of the mode switch 13 will be described. In the first auto-plucking play mode $OP_1$, musical tones having a certain pitch are sequentially generated on the basis of the plucking data (plucking timing data, plucking force data) which have been stored on MOM card, without any fret operation on any of fret positions. In the present embodiment, sounds of musical tones having open-string pitches which are the same as those generated by plucking operation of the open string are automatically outputted through the musical-tone generation section 38 at the sound-generation timing designated by the plucking data. And predetermined portions of respective strings 4 are automatically lightened in the predetermined order at the timing designated by the plucking data in synchronism with the above mentioned sound generations. The performer can listen to the plucking sounds automatically generated and can visually confirm the state of the light-emission display of the string as will be described, so that the perfomer can learn rapidly end easily the modes of plucking and the plucking order.

Hereinafter, the operation in the first auto-plucking play mode will be specifically described for each mode of plucking.

a. Alternate Plucking

The mode switch 13 is switched from the normal mode N to the first auto-plucking play mode $OP_1$. Then, the read out address of the address control section 46 is reset to "0" by CPU 37. And thereafter, when the auto-plucking start switch OSW is turned on, the plucking data at the leading address of ROM/RAM card is latched at the latch 52. If the plucking data at the leading address of ROM/RAM card 17 is the alternate plucking data, AND gates A12 through A25 of FIG. 5A are caused to open, and thereby a twelve-stage circulation counter of a closed loop type is formed with flip-flops $F_8$ through $F_{19}$. Therefore, a signal "1" is shifted through the flip-flops $F_8$ through $F_{19}$ at the period of the frequency-division clock signal generated in accordance with set tempo data delivered from the frequency division circuit 53.

While, the signal "1" is sequentially shifted from the flip-flop $F_8$ to the flip-flop $F_{13}$, the signal "1" is sequentially inputted to OR gates 02 through 07 in the order from 02 to 07 through AND gates A12 to A17 and thereby the signal "1" is outputted from these OR gates 02 to 07. Therefore, as shown in FIGS. 4 and 5A, the signal "1" is sequentially supplied to output line of respective flip-flops $F_1$ to $F_6$ and also to respective trigger LEDs $12_1$ to $12_6$. Since the signal "1" supplied to the output lines of these flip-flops $F_6$ to $F_1$ is delivered as a musical-tone trigger signal TS through the key-code generation circuit 36 to the sound source circuit 41, musical tones having open string pitch is sequentially generated in the order from the sixth string to the first string in response to these musical-tone trigger signal TS. The plucking play in the down direction is performed with these musical tones. At the same time, since the signal "1" is supplied to respective trigger LEDs $10_6$ to $10_1$, these trigger LEDs $10_6$ to $10_1$ are sequentially turned on in the order from the sixth string to the first string. With these turn-on display, the plucking in the down direction is visually indicated.

In the meantime, while shifted from the flip-flop $F_{14}$ to the flip-flop $F_{19}$, the signal "1" is sequentially inputted to OR gates 07 to 02 through the AND gates A25 to A20. In consequence, since the signal "1" is sequentially delivered from these OR gates 07 to 02, the signal "1" sequentially supplied to the output lines of respective flip-flops $F_1$ to $F_6$ and respective trigger LEDs $12_1$ to $12_6$ in the same manner as the described above. Therefore, the plucking sounds are sequentially outputted in accordance with the plucking operation in the up-direction from the first string to the sixth string, conversely to the plucking sounds in the above mentioned down direction. At the same time, since the signal "1" is supplied to the respective trigger LEDs $10_1$ to $10_6$, the trigger LEDs $10_1$ to $10_6$ are sequentially turned on in the order from the first string to the sixth string. The plucking operation in the up-direction can be visually displayed with this turn-on display. As the result, the sound generation and display of the plucking sounds caused by alternate plucking operation of strings can be achieved by means of the above mentioned flip-flops $F_8$ to $F_{19}$.

b. Down Plucking

If the plucking data read out from ROM/RAM card 17 is the down plucking data, the down plucking data is set at the latch 52 and thereby AND gates A10 to A17 are caused to open. Then, a six-stage circulation counter of a closed loop type is formed with flip-flops $F_8$ to $F_{13}$. Accordingly, the signal "1" is sequentially shifted from the flip-flop $F_8$ to the flip-flop $F_{18}$ at the rate decided by the set tempo. In consequence, since the signal "1" is sequentially supplied to the output lines of respective flip-flops $F_6$ to $F_1$, the plucking sounds are sequentially outputted in the order from the sixth string to the first string. Therefore, the plucking sounds only in the down direction are outputted with the sound-generation condition mentioned above. At the same time, since the trigger LEDs $10_6$ to $10_1$ are sequentially turned on in the direction from the sixth string to the first string, the plucking operation only in the down direction can be visually displayed by the turn-on display state mentioned above.

In this manner, the plucking sounds can be automatically outputted in accordance with the stored plucking data without actual plucking operation of the strings $\phi$, and the trigger LEDs $10_1$ to $10_6$ corresponding to the outputted sounds can be sequentially turned on. Therefore, since the performer can listen to the plucking sounds and visually confirm the direction and the order in which the respective trigger LEDs 10 are turned on, the performer is allowed to smoothly and firmly learn the plucking operations of various modes.

The up-plucking operation will not be described, since the same processing operation as that executed in the plucking operation in the up-direction in the alternate plucking operation is effected.

The tempo of reading out of the plucking data can arbitrarily be set by operation of the tempo knob 15 of FIG. 1A.

It has been described that specified musical tones having open-string pitches are automatically generated in accordance with the plucking data stored in the ROM card 17 in the first auto-plucking play mode $OP_1$.

Next, the processing operation to be effected when the performer performs fingering operations in addition to the auto-plucking operation will be described referring to a flow chart shown in FIG. 10.

As described above, the pucking data stored on ROM card 17 are read out from CPU 37 (at Step V-1). When the fingering operation is effected in synchronism with the rate of reading out of the plucking data, these fingering operations activate relevant fret switches PSW. Then pitch-designation signals FC corresponding to the fret-switches PSW are generated at the key-scan circuit 40 and the key-code generation circuit 36. Hence, the pitch data corresponding to the operated fret switches PSW and the plucking data read out as mentioned above are delivered to the sound-source circuit 41 (at Step V-3). Therefore, musical tones having specific pitches designated by the fingering operation can be sequentially generated at the timing specified by the above mentioned plucking data. Accordingly, the performer can sequentially generate musical tones (plucking sounds) having specific pitches with the left-hand fingering operation without any plucking operation by the right hand. When the fingering operation is not effected, only the read-out plucking data are delivered to the sound source circuit 41 (at Step V-4) and in the same way described above, musical tones (plucking sounds) having open string pitches are sequentially generated at the timing defined by the plucking data.

D. Second Auto Plucking Play Mode

Processing Operation to be executed when the mode switch 13 is set to the second auto-plucking play mode will be described. In the second auto-plucking play mode, the plucking data is reproduced, which has been written in by a real-time input processing operation.

Figure 10:
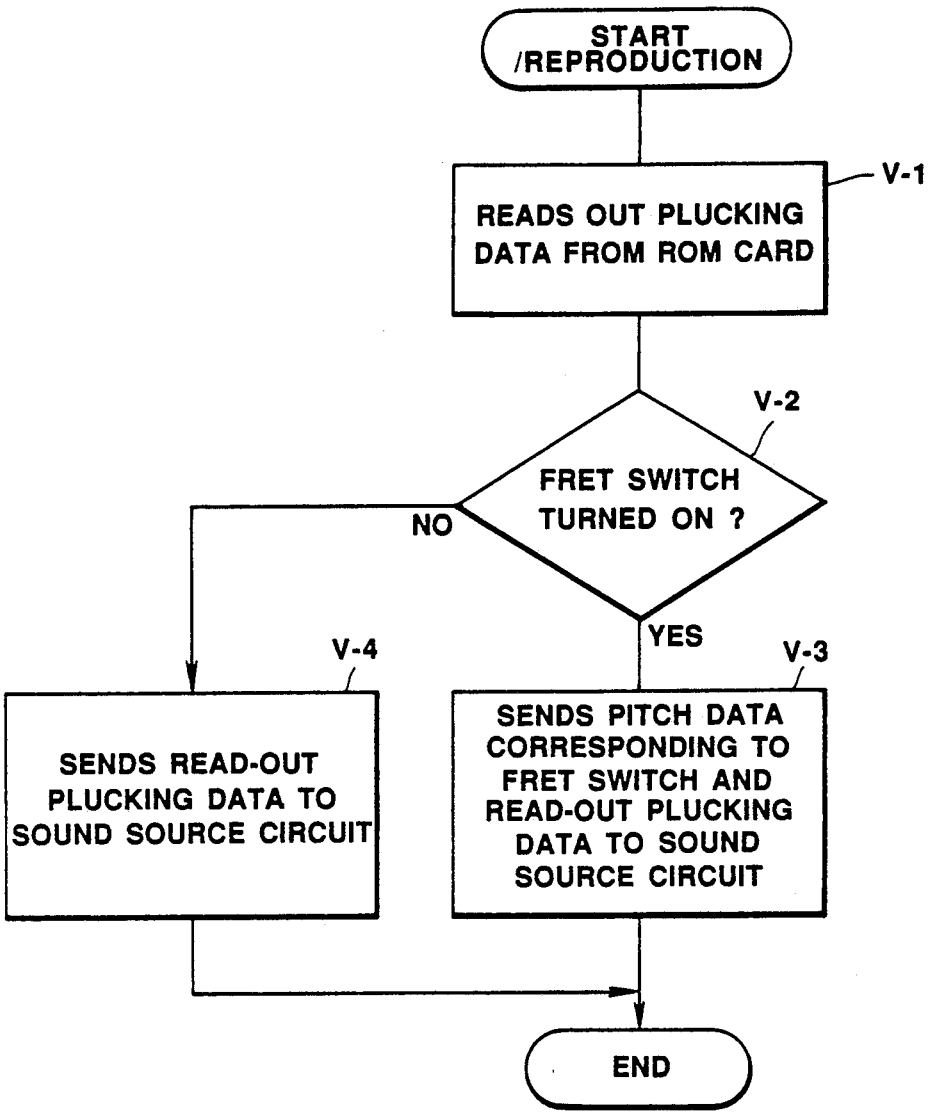
Figure 11:
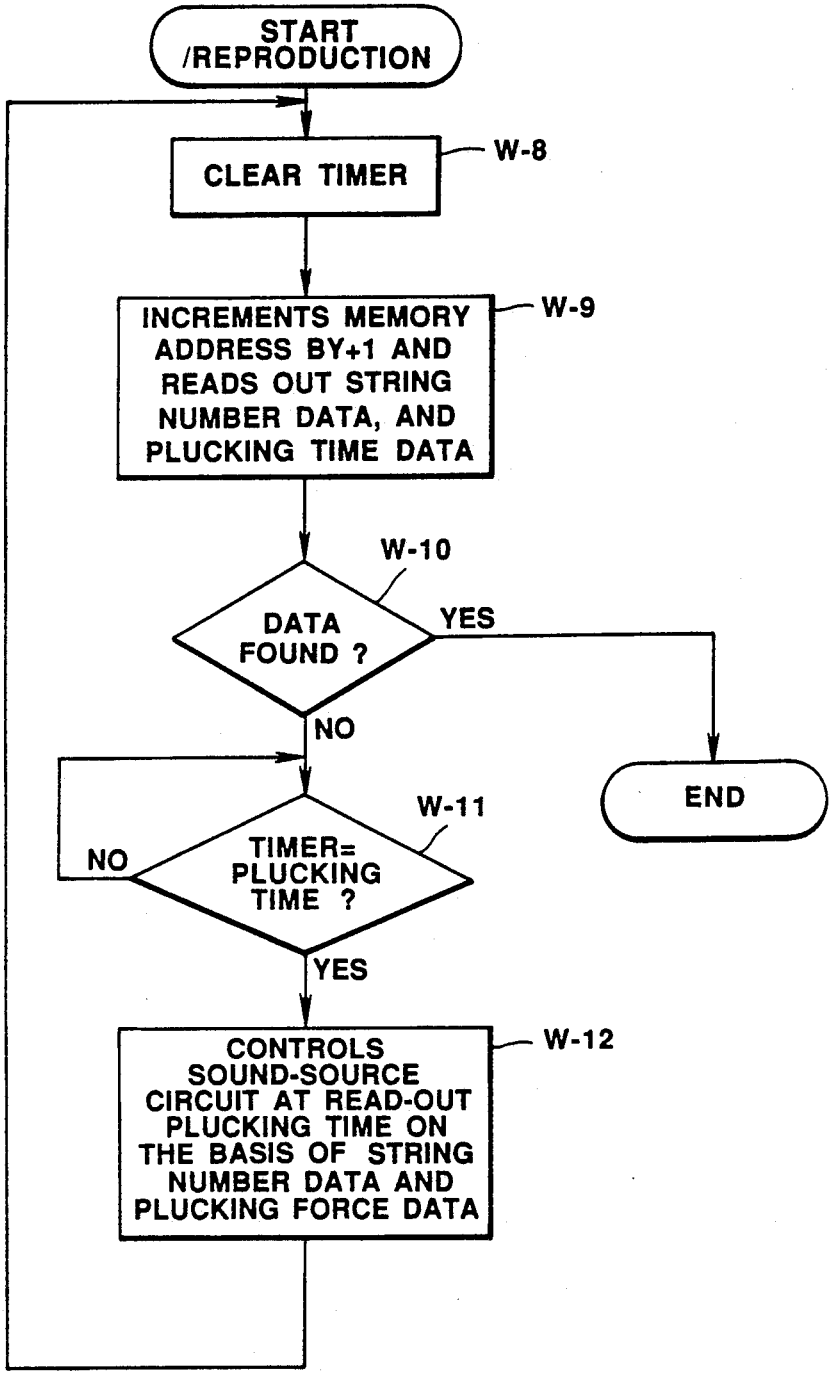

FIG. 10 is a flow chart of the processing operation executed when the auto-plucking performance is effected on the basis of the plucking data read out from RAM card 17, which plucking data have been written in at real time in accordance wth the plucking timing indicated in the musical note of FIG. 6B. This flow of the processing operation starts with a timer interruption caused in the main routine (not shown) of CPU 37 or repeated operations executed at a predetermined timing.

After the performance has started, the timer in CPU 37 is cleared (at Step W-8) and then address in RAM card 17 is incremented by +1. Since the string-number data, the plucking timing data and the plucking accent data have been stored at the memory aread relevant to the address 1 of FIG. 6B, these data are read out from ROM/RAM card 17 (at Step W-9). Then, it is discriminated whether or not the plucking data to be read out is found (at Step W-10). When the result is "YES", an automatic sound generation process is presumed to have been completed and the flow of the processing operation is terminated. When the result is "NO", it is discriminated (at Step W-11) whether or not the count value has reached the time at which the plucking data is read out, i.e., the plucking time $t_1$ at which a sound of musical tone is to be outputted. When th result is "NO", operation at Step W-11 is repeatedly executed until the result becomes "YES". When the count value of the timer has reached the plucking time $t_1$, a control signal is delivered to the sound source circuit 41 for starting sound generation (at Step W-12), and the sound of musical tone of plucking sound having the sixth open-string pitch is outputted in accordance with respective data stored at areas corresponding to the memory address 1 of FIG. 6B, such as 3-bit digital data 101 representing the string-number of the sixth string and other 3-bit digital data 111 representing the plucking force at the time $t_1$. In consequence, the musical tone having the open-string pitch can be generated at the plucking time $t_1$.

After the musical tone has been generated, the processing operation returns to Step W-8 and in the same manner as described above, the plucking data stored at the area relevant to the memory address 2 is read out and then at the plucking time $t_2$ contained in the above read out data, the plucking sound having the fifth open-string pitch is outputted. The processing operation mentioned above is executed for every address and when the plucking data to be read out has not been found, the flow of the processing operation is terminated.

Figure 12:
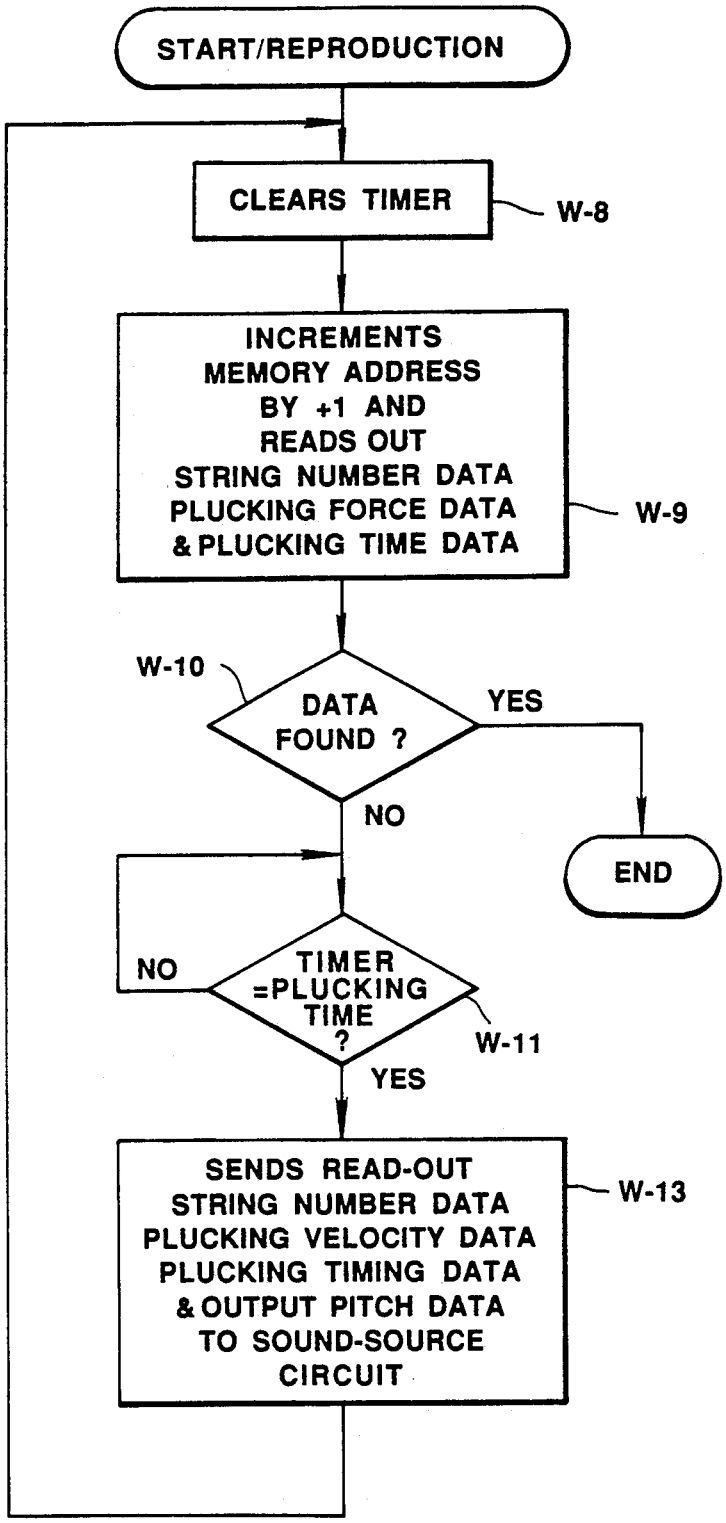

The processing operation has been described, which is executed when the plucking sound having the open-string pitch is generated without the fingering operation. However, when, as shown in FIG. 12, the performer designates certain pitches or codes in a predetermined order by depression operation of the fret-switches PSW with his or her left hand in synchronism with the auto-plucking operation in the second auto-plucking play mode, the pitch-designation signals FC relevant to the depressed fret switches PSW are supplied from the key-scan circuit 40 to the key-code generation circuit 36. Therefore, the pitch data relevant to the depressed fret switches PSW and the plucking data automatically read out from RAM card 17 (Steps W-8 to W-11) can be supplied to the sound source circuit 41 (at Step W-13). As the result, the musical tones having pitches corresponding to the above pitch data can be outputted at the timing defined by the plucking data automatically read out from RAM card 17. In this manner, melody performance and code performance can be enjoyed. Accordingly, since the performer can generate musical tones having pitch designated by the fret operation with his or her left hand, the performer is allowed to strain every nerve to fret operation with the left hand without worrying about plucking operation with the right hand. Those who are not skilled in playing a musical instrument can enjoy melody performances on his instrument without worrying about playing operation.

In the above mentioned embodiment, the auto-plucking performance in down plucking operation has been described, but the mode of plucking operation is not always limited to the down-plucking operation. Auto-plucking performance can be executed in other modes of plucking operation, such as up plucking, alternate plucking and arpeggio plucking. An arbitrary setting of the tempo to read out the auto-plucking data by controlling the tempo knob 15 allows to reproduce the plucking sounds at the timing different from that at which the plucking sounds have been recorded at real time.

E. Third Auto Plucking Play Mode

The processing operation to be executed when the mode switch 13 is set to the third auto-plucking play mode will be described. In the third auto-plucking play mode, the plucking data are reproduced, which have been written in a step-input fashion.

Figure 13:
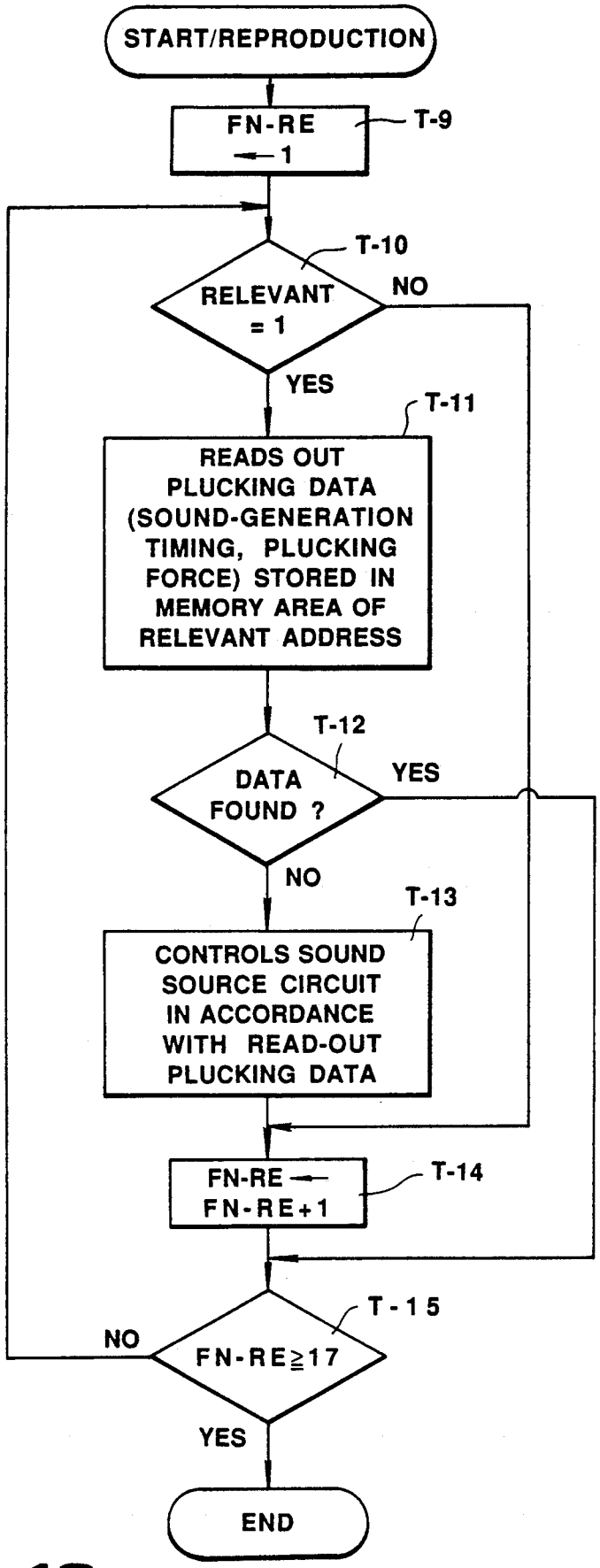

FIG. 13 is a flow chart of the processing operation to automatically generate the plucking sounds in accordance with the plucking data read out from RAM card 17, which plucking data have been written into RAM card 17 in a step input fashion in accordance wth the flow chart of FIG. 8A. The flow chart of the processing operation starts with a timer interruption caused in the main routine operation (not shown) of CPU 37 or repeated operation executed at a predetermined timing.

After a performance has been started, a value "1" is substituted to the content of the corresponding fret-number register FN-RE (at Step T-9) in order to prepare to read out the plucking data corresponding to the position of the first fret 9-1, i.e., the plucking data given at the timing 1 of FIG. 9. It is discriminated (at Step T-10) whether or not the value "1" is raised at the corresponding fret-number flow chart FN-FR. In case the result is "YES", the plucking data to be acoustically outputted at the first beat has been stored at the memory area of RAM card 17 relevant to the position of the first fret 9-1, so that the plucking data (sound-generation timing data and plucking force data) stored at the memory area are read out. For example, the plucking timing data and 3-bit digital data 100 are read out. The plucking timing data represents the times (the first beat) corresponding to the timing 1 as shown in FIG. 9, at which respective strings, from the sixth string to the first string are to be plucked and the 3-bit digital data represents the force by which the string is plucked at the above mentioned timing. Thereafter, while the plucking data to be read out has been found (at Step T-12), sound-generation control signals are delivered to the sound source circuit 41 (at Step T-13) and the plucking sounds are generated at the plucking timings corresponding to respective strings at the plucking timing (the first beat) contained in the read-out plucking data. Then, the content of the fret-number register FN-RE is incremented by "1", and the following fret number, in this case data 2 representing the second fret is set to the register FN-RE (at Step T-14). It is discriminated (at Step T-15) whether or not the content of the fret-number register FN-RE has become more than 17 but at present $2 \leqq 17$ is given and the result is "NO". Accordingly, the processing operation returns to Step T-10. The processing operation at Steps T-10 through T-15 are executed in the same manner described above to sequentially read out the plucking data having contents as indicated in FIG. 9 and thereby an automatic sound generation control is effected. When FN-RE$\geqq$17 has been discriminated, which means that read out or reproductin of all of the data has been completed, then the flow of the processing operation is terminated.

In this case, when the performer performs fret operation to designate pitches or codes in synchronism with the auto-plucking play in the third auto-plucking play mode, melody sounds or code sounds having pitches relevant to the fret operation by the performer can be outputted at the timing designated by the auto-plucking data. A control of the tempo knob 15 for the auto-plucking play allows to arbitrarily set a time interval between the times at which the plucking sounds of each string are generated or a time interval between the times at which the plucking sounds for each beat are generated, in accordance with the tempo data set by means of the tempo knob 15.

Further, in the above mentioned embodiment, the automatic performance of the data which have been step-inputted in the down-plucking has been described, but the automatic performance of the data which have been step-inputted in other plucking modes such as up plucking, alternate plucking and the like are possible in the similar manner to the mentioned above.

Figure 14:
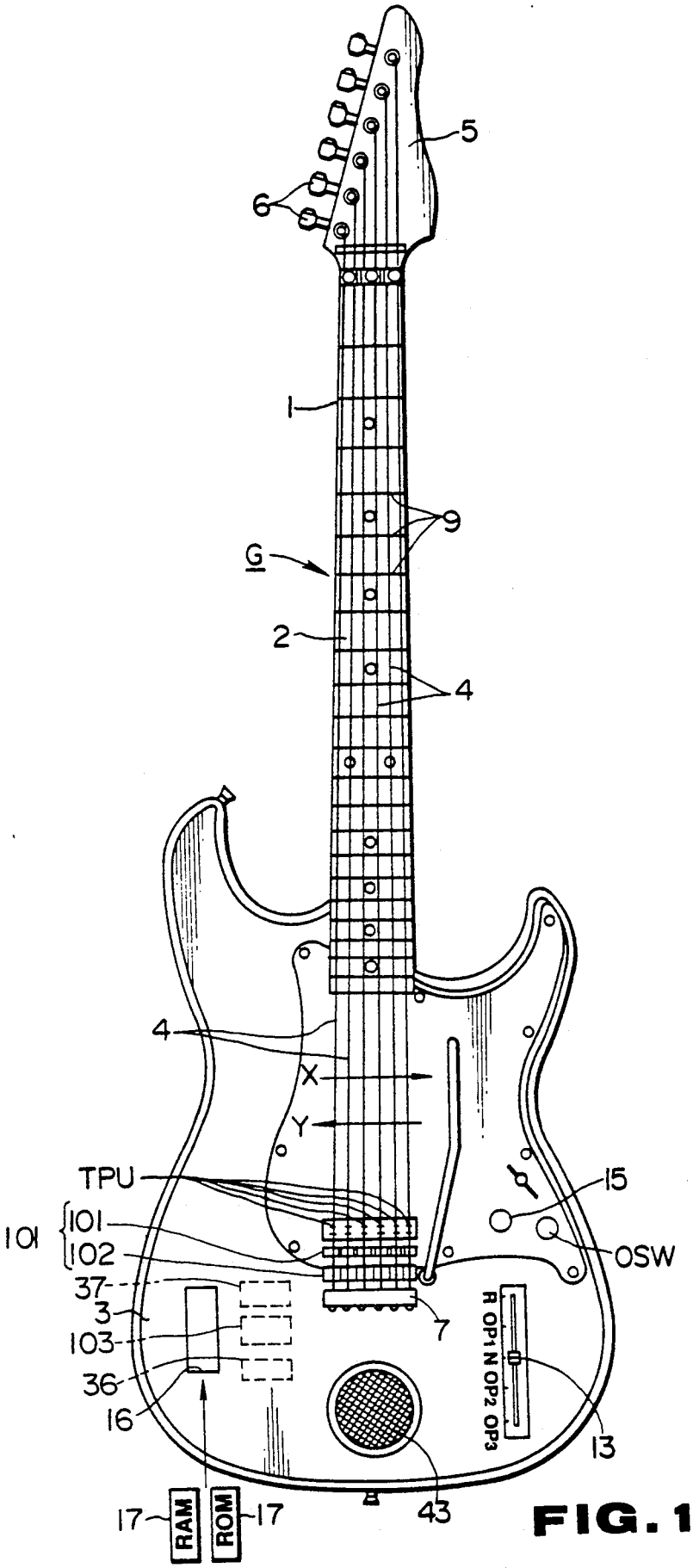
Figure 15:
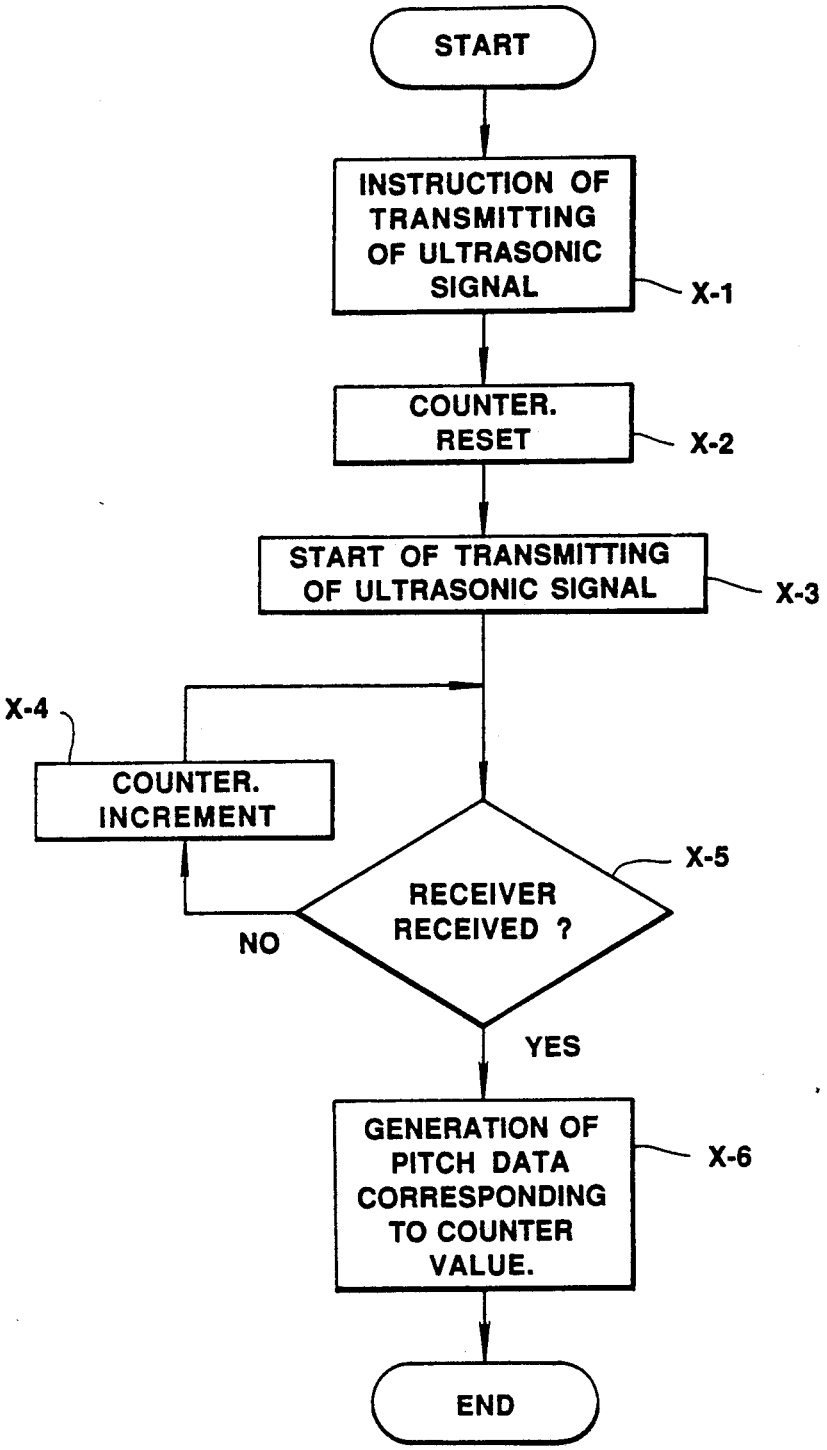

FIGS. 14 and 15 illustrate other embodiment according to the present invention.

In the present embodiment, a reproducing apparatus according to the invention for reproducing plucking sounds is applied to an electronic stringed insrument of an ultrasonic detection type. Like materials or elements as those in the above mentioned embodiment are designated by like reference symbols.

The electronic stringed instrument of the present embodiment is provided with an operation-position detecting section 100 which detects positions of fingering operation on a number of strings 4, using an ultrasonic wave. The operation-position detecting section 100 comprises a transmitter 101, a receiver 102, a counter 103 and a key-code generation circuit 36. The transmitter 101 sequentially transmits ultrasonic-wave signals to the strings 4 at a predetermined time interval. The receiver 102 receives ultrasonic wave signals reflected from the contact point of the string 4 depressed by fingering operation with fret 9. The counte 103 counts a time duration from the time at which the ultrasonic-wave signal is transmitted from the transmitter 101 to the string 4 to the time at which the transmitted ultrasonic-wave signal is received by the receiver 102. The key-code generation circuit 36 generates relevant data (key code data) in accordance with the connected data outputted from the counter 103.

The process which causes the operation-position detecting section 100 to generate a certain pitch data will be described referring to the flow chart shown in FIG. 15.

CPU 37 sends an instruction to the transmitter 101 to transmit ultrasonic-wave signals (at Step X-1). The counter is reset in response to the above mentioned instruction (at Step X-2). The transmitter 101 transmits ultrasonic-wave signals to the string 4 (at Step X-3). The ultrasonic-wave signal transmitted to the string 4 is reflected from the contact point of the depressed by fingering operation with the fret 9. The reflected ultrasonic-wave signal travels along the string towards the receiver 102. The counter 103 continues its increment operation, increasing the count data until the receiver 102 receives the reflected ultrasonic-wave signal (at Step X-4). The counter 103 counts the count data at the time when the receiver 102 has received the reflected ultrasonic-wave signal. The key-code generation circuit 36 generates pitch data (key-code data) corresponding to the above mentioned count data (at Step X-4). In this manner, the fingering operation to the strings 4 can cause the key-code generation circuit 36 to generate relevant pitch data.

Accordingly, in the same way as the embodiment shown in FIG. 10, even in case of the electronic stringed instrument of the ultrasonic wave detection type, the pitch data and the plucking data can be supplied to the sound source circuit 41, when the fingering operation is performed to the string 4 to generate the pitch data in synchronism with reading out operation of the plucking data stored in ROM card 17 (Refer to Step V-13 in FIG. 10). Therefore, as in the case of the embodiment described above, the performer of the instrument can sequentially generate musical tones (plucking sounds) having a predetermined pitch only by fingering operation without any plucking operation.

In the above embodiments, ROM/RAM card 17 is employed as memory means for storing plucking data, but built-in ROM or RAM, a magnetic tape, a magnetic disc, an optical disc and the like can be used for the same purpose. The plucking data mentioned above may contain arpeggio data and various data such as chopper base plucking and the like in addition to the above mentioned data.

Further, the embodiments of the present invention have been described which are applied to the electronic stringed invention, but the embodiment of the present invention may be applicable to other electronic stringed instrument which has no pitch-designation means.

Furthermore, the present invention is used in the instrument which has the pitch-designation switch PSW of a switching type as the pitch-designation means for designating tone pitches, or the position detection system for designating tone pitches on the basis of the propagation delay time of ultrasonic wave signals transmitted to the strings. But the present invention is applicable to an instrument which has a resistance-detection system or a contact system as the pitch designation means. The resistance-detection system is disclosed for example in U.S. Pat. No. 4,235,141 and the contact system uses contacts between conductive frets and conductive strings to which electric current is supplied, as disclosed for example in U.S. Pat. No. 4,658,690.

A string-vibration detection means is in no way limited to the pick-up device TPU of an electromagnetic type used in the embodiments but the present invention is applicable to a device using a Hall element and a magnet, as disclosed, for example, in U.S. Pat. No. 4,658,690 and a touch-switch method as disclosed, for example, in U.S. Pat. Nos. 4,336,734, 4,339,979, 4,248,128 and 4,078,464, and also to a laser beam interruption system.

What is claimed is:

1. A plucking sound generation instrument comprising:

a fingerboard having a plurality of fingering operation tracks;

pitch-data output means for outputting pitch data responsive to a player's manual fingering operation performed on any one of positions within a plurality of said fingering operation tracks,;

plucking-timing data output means for automatically and sequentially outputting plucking-timing data which indicate generation timings for a series of plucking sounds defining a musical piece without a manual plucking operation of the player; and instruction means for instructing sequential generation of a plurality of plucking sounds of said musical piece without a player's manual operation, said plucking sounds having a pitch corresponding to said pitch-data and having timings corresponding to said plucking-timing data.

2. A plucking sound generation instrument according to claim 1, further comprising plucking-sound generation means for sequentially generating said plucking sounds in accordance with instructions from said instruction means.

3. A plucking sound generation instrument according to claim 1, wherein said plucking-timing data output means comprises:

memory means for storing a series of plucking data representing said timings at which a plurality of plucking sounds corresponding to respective strings are generated; and read out means for sequentially reading out a series of plucking data stored in said memory means.

4. A plucking sound generation instrument according to claim 1, wherein said plucking-timing data output means comprises means for automatically outputting said plucking-timing data to generate at the same time a plurality of plucking sounds for respective strings.

5. A plucking sound generation instrument according to claim 1, wherein said plucking-timing data output means comprises means for automatically sequentially outputting said plucking-timing data to generate a plurality of plucking sounds for respective strings at predetermined time intervals.

6. A plucking sound generation instrument comprising:

a fingerboard having a plurality of fingering operation tracks;

pitch-data output means, responsive to a player's manual fingering operation performed on any one of positions within a plurality of said fingering operation tracks, for outputting pitch data for every fingering operation track on which said fingering operation is performed and corresponding to said position on which said fingering operation is performed;

timing-data output means for automatically outputting timing data to generate in predetermined order a plurality of plucking sounds for the respective fingering operation tracks, thereby defining a musical piece without manual plucking operation of the player; and instruction means for instructing generation of plucking sounds of said musical piece without a player's manual plucking operation, said plucking sounds each having a pitch in accordance with said pitch data output from said pitch data output means, and said plucking sounds being generated every time said timing data are output from said timing data output means.

7. A plucking sound generation instrument according to claim 6, further comprising setting means for setting time intervals at which said plurality of plucking sounds are to be generated.

8. A plucking sound reproducing instrument comprising:

a fingerboard having a plurality of fingering operation tracks on which fingering operation is performed by a player;

pitch-data output means for outputting pitch data responsive to a player's manual fingering operation performed on any one of positions within said fingering operation tracks, said pitch data corresponding to positions on which fingering operation is performed;

plucking-timing data output means for automatically and sequentially outputting plucking-timing data which indicate generation timings for a series of plucking sounds defining a musical piece without a manual plucking operation of the player; and instruction means for instructing sequential generation of said plucking sounds of said musical piece without a player's manual operation, said plucking sounds having a pitch corresponding to said pitch-data and having timings corresponding to said plucking-timing data.

9. A plucking sound generation instrument comprising:

a fingerboard having a plurality of fingering operation tracks;

a plurality of strings stretched along said respective fingering operation tracks;

pitch-data output means for outputting pitch data responsive to a player's manual fingering operation performed on any one of said strings;

plucking-timing data output means for automatically and sequentially outputting plucking-timing data which indicate generation timings for a series plucking sounds defining a musical piece without a manual plucking operation of the player; and instruction means for instructing sequential generation of a plurality of plucking sounds of said musical piece without a player's manual plucking operation, said plucking sounds having a pitch corresponding to said pitch-data and having timings corresponding to said plucking-timing data.

10. A plucking sound generation instrument according to claim 9, further comprising musical tone generation means for sequentially generating said plucking sounds in accordance with instructions from said instruction means.

11. A plucking sound generation instrument according to claim 9, wherein said pitch data output means comprises:

detection means for detecting fingering positions on said respective strings at which a player's manual fingering operation is performed; and output means for outputting pitch data corresponding to said respective strings and to the fingering positions detected by said detection means.

12. A plucking sound generation instrument according to claim 11, wherein said detection means comprises:

transmitting means for sequentially transmitting ultrasonic signals to said respective strings;

said ultrasonic signals transmitted from said transmitting means to said strings being reflected at said fingering positions where fingering operation is performed;

receiving means for receiving said reflected ultrasonic signals; and means for detecting said fingering position on the basis of a time interval between the time when said transmitting means transmits said ultrasonic signals to said respective strings and the time when said receiving means receives said reflected ultrasonic signals.

13. A plucking sound generation instrument comprising:

a fingerboard having a plurality of fingering operation tracks;

a plurality of strings stretched along said respective fingering operation tracks;

pitch data output means for outputting pitch data responsive to a player's manual fingering operation performed on any one of said strings;

timing data output means for automatically outputting timing data for generating each plucking sound for each string in a predetermined order to define a musical piece without a manual plucking operation of the player; and instruction means for instructing generation of plucking sounds of said musical piece without a player's manual plucking operation, said plucking sounds each having a pitch in accordance with pitch data output from said pitch-data output means, and said plucking sounds being generated every time said timing-data output means outputs said timing data.

14. A plucking sound generation instrument according to claim 13, further comprising setting means for setting time intervals of generation timings for each of said plucking sounds.

15. A plucking sound generation instrument comprising:

strings stretched along a fingerboard;

pitch-data output means for outputting pitch data responsive to a player's manual fingering operation performed on any one of positions on said strings;

plucking-timing data output means for automatically and sequentially outputting plucking-timing data which indicate generation timings for a series of plucking sounds defining a musical piece without a manual plucking operation of the player; and instruction means for instructing sequential generation of plucking sounds when said plucking timing data have been outputted from said pitch-data output means while respective fingering operations remain performed on said strings, said plucking sounds each having a pitch corresponding to the fingering position on which said fingering operation is performed.

16. A plucking sound generation instrument according to claim 15, further comprising musical tone generation means for sequentially generating said plucking sounds in accordance with instruction given by said instruction means.

17. A plucking sound generation instrument according to claim 15, wherein said pitch-data output means comprises:

detection means for detecting fingering positions on said respective strings at which a player's manual fingering operation is performed; and output means for outputting pitch data indicating pitch corresponding to the fingering position detected by said detection means.

18. A plucking sound generation instrument according to claim 17, wherein said detection means comprises:

transmitting means for sequentially transmitting ultrasonic signals to said respective strings;

said ultrasonic signals transmitted from said transmitting means to said strings being reflected at said fingering positions where fingering operation is performed;

receiving means for receiving said reflected ultrasonic signals; and means for detecting said fingering position on the basis of a time interval between the time when said transmitting means transmits said ultrasonic signals to said respective strings and the time when said receiving means receives said reflected ultrasonic signals.

19. A musical instrument having means for storing plucking timing data representing timing of a player's manual plucking operation performed on strings, said plucking data memory instrument comprising:

at least one string stretched on an instrument body;

string vibration detection means for detecting vibration of said at least one string on a real time basis;

memory means; and writing means for sequentially writing timing data into said memory means on a real time basis responsive to said string vibration detection means detecting a start of vibration of said at least one string, said timing data indicating timings of start of string vibration.

20. A plucking sound generation instrument comprising:

memory means for storing plucking timing data indicating generation timings for plucking sounds to be sequentially generated;

reading means for sequentially reading out said plucking timing data stored in said memory means; and instruction means for instructing so sequential generation of said plucking sounds at timings indicated by said plucking-timing data read out by said reading means, said plucking sounds each having a particular pitch.

21. A plucking sound generation instrument according to claim 20, further comprising musical-tone generation means for sequentially generating, in accordance with instruction from said instruction means, said plucking sounds each having a particular pitch.

22. A plucking sound generation instrument according to claim 21, wherein said musical-tone generation means includes means for sequentially generating said plucking sounds each having a particular pitch, wherein said particular pitch is an open-string pitch.

23. A plucking sound generation instrument according to claim 21, wherein said plucking sound generation instrument comprises an instrument body and said musical-tone generation means is provided on said instrument body.

24. A plucking data memory instrument for storing plucking data for automatically generating plucking sounds, said plucking data memory instrument comprising:

a plurality of strings stretched on an instrument body;

string vibration detecting means detecting string vibration of said strings on a real time basis;

memory means; and writing means for writing timing data and number data into said memory means on a real time basis responsive to said string vibration detecting means detecting a start of vibration of said respective strings, said timing data indicating timings of start of vibration of said respective strings and said number data corresponding to a string number of said string which starts a vibration.

25. A plucking sound generation instrument comprising:

at least one string for generating plucking sounds;

memory means for storing plucking-timing data and string number data respectively, aid plucking timing data indicating generation timings for plucking sounds to be sequentially generated and said string number data corresponding to a string number of said at least one string which generates said plucking sound;

reading means for sequentially reading out said timing data and said string number data stored in said memory means; and instruction means for instructing sequential generation of plucking sounds each having a particular pitch, said plucking sounds being generated at timings indicated by said timing data read out by said reading means, and said plucking sounds each corresponding to a particular string indicated by said string number read out by said reading means.

26. A plucking sound generation instrument according to claim 25, further comprising musical-tone generation means for sequentially generating in accordance with instruction from said instruction means, said plucking sounds each having a particular pitch and corresponding to a particular string.

27. A plucking sound generation instrument according to claim 26, wherein said musical tone generation means includes means for sequentially generating said plucking sounds each having a particular pitch and corresponding to a particular string, wherein said particular pitch is an open string pitch.

28. A plucking sound generation instrument according to claim 26, wherein said plucking sound generation instrument comprises an instrument body and said musical tone generation means is provided on said instrument body.

29. A plucking data memory instrument comprising:

at least one string stretched on an instrument body;

string-vibration detecting means for detecting vibrations of said at least one string on a real time basis;

memory means; and writing means for sequentially writing timing data and plucking velocity data into said memory means on a real time basis, every time said string-vibration detecting means detects a start of a vibration, said timing data indicating timings of start of string vibration and said plucking velocity data indicating amplitude of string vibration at the time of vibration or thereafter.

30. A plucking sound generation instrument comprising:

memory means for storing plucking timing data and plucking velocity data, said plucking timing data indicating generation timings for plucking sounds to be sequentially generated and said plucking velocity data indicating sound volume of said plucking sounds to be generated;

reading means for sequentially reading out said timing data and said plucking velocity data stored in said memory means; and instruction means for instructing sequential generation of plucking sounds at timings indicated by said timing data read out by said reading means, said plucking sounds having sound volume corresponding to said plucking velocity data.

31. A plucking sound generation instrument according to claim 30, further comprising musical-tone generating means for sequentially generating said plucking sounds in accordance with instruction from said instruction means.

32. A plucking data memory instrument comprising:

detecting means for detecting a plurality of fingering positions assigned to respective generation timings of plucking sounds to be generated;

memory means; and writing means for writing plucking data into said memory means when said detecting means detects particular fingering positions from among said plurality of fingering positions, said plucking data representing generation timings of said plucking sounds and corresponding to said particular fingering positions detected by said detecting means.

33. A plucking data memory instrument comprising:

detecting means for detecting a plurality of fingering positions assigned to respective generation timings of a group of plucking sounds to be sequentially generated at predetermined time intervals;

memory means; and writing means for writing plucking-timing data into said memory means when said detecting means has detected particular fingering positions from among said plurality of fingering positions, said plucking-timing data indicating generation timings of a group of said plucking sounds and corresponding to said particular fingering positions detected by said detecting means.

34. A plucking data memory instrument according to claim 33, wherein said plucking-timing data memory instrument comprises strings and said plucking-timing data written into said memory means by said writing means indicates timings at which plucking operation is to be performed in a predetermined order on said strings.

35. A plucking data memory instrument comprising:
at least one stretched string;
string-vibration detecting means for detecting vibration of said at least one string;
detection means for detecting a plurality of fingering positions assigned to respective generation timings of a group of plucking sounds to be sequentially generated at predetermined time intervals;
memory means; and
writing means for writing plucking-timing data into said memory means when said string-vibration detecting means detects string vibration and said detection means detects particular fingering positions from among said plurality of fingering positions, said plucking-timing data indicating generation timings corresponding to said particular fingering positions detected by said detection means.

36. A plucking data memory instrument comprising:
at least one stretched string;
string-vibration detecting means for detecting vibration of said string;
detection means for detecting a plurality of fingering positions assigned to respective generation timings of a group of plucking sounds to be sequentially generated at predetermined time intervals;
memory means; and
writing means for writing plucking-timing data and number data into said memory means, respectively, when said string-vibration detecting means detects string vibration and said detection means detects particular fingering positions from among said plurality of fingering positions, said plucking-timing data indicating generation timings corresponding to said particular fingering positions detected by said detection means and said number data indicating a plurality of string numbers corresponding to said at least one stretched string to be plucked at said timings to generate said plucking sounds.

37. A plucking data memory instrument comprising:
at least one stretched string;
string-vibration detecting means for detecting vibration of said string;
detection means for detecting a plurality of fingering positions assigned to respective generation timings of a group of plucking sounds to be sequentially generated at predetermined time-intervals;
memory means; and
writing means for writing plucking timing data into said memory means when said string-vibration detecting means detects string vibration and said detection means detects particular fingering positions from among said plurality of fingering positions, and for writing sound volume data into said memory means at said generation timings, said plucking-timing data indicating generation timings corresponding to said particular fingering positions detected by said detection means, and said sound volume data indicating sound volume of said group of plucking sounds.

38. A plucking data memory instrument according to claim 37, wherein said sound volume data indicates a value corresponding to amplitude of said string vibration detected by said string-vibration detecting means.

39. A plucking data memory instrument comprising:
at least one stretched string;
detection means for detecting a particular fingering position from among a plurality of fingering positions which is assigned to a respective generation-timing for at least one plucking sound to be sequentially generated;
memory means; and
writing means for writing plucking-timing data into said memory means when said detection means detects said particular fingering position, said plucking-timing corresponding to said detected particular fingering position.

40. A plucking data memory instrument comprising:
at least one stretched string;
detection means for detecting a particular fingering position from among a plurality of fingering positions which is assigned to a respective generation-timing for at least one plucking sound to be sequentially generated;
memory means; and
writing means for writing plucking-timing data into said memory means when said detection means detects said particular fingering position, said plucking-timing data indicating said generation-timing corresponding to said detected particular fingering position, and said writing means also writing sound volume data representing sound volume of said at least one plucking sound at the time of said generation-timing.

41. A plucking data memory instrument comprising:
a fingerboard provided on an instrument body;
at least one string stretched on said instrument body;
at least one operation-area formed on said fingerboard and having operation positions defined with respect to said at least one string;
detecting means for detecting operation of particular operation positions;
timing-designation means for designating said particular operation-positions detected by said detecting means as plucking-timing positions indicating generation-timings for a group of plucking sounds to be sequentially generated at predetermined time intervals;
memory means; and
writing means for writing plucking-timing data into said memory means when said detecting means detects operation of said particular operation-positions, said plucking-timing data corresponding to said particular plucking-timing positions designated by said timing designation means.

42. A plucking data memory instrument comprising:
a fingerboard provided on an instrument body;
at least one string stretched on said instrument body;
at least one operation-area formed on said fingerboard and having operation positions defined with respect to said at least one string;
detecting means for detecting operation of particular operation positions;
timing-designation means for designating said particular operation-positions detected by said detecting means as plucking-timing positions indicating generation-timings for plucking sounds to be generated;

memory means; and writing means for writing plucking-timing data into said memory means when said detecting means detects operation of said particular operation-positions, said plucking-timing data corresponding to said particular plucking-timing positions designated by said timing designation means.

43. A plucking data memory instrument comprising:

a fingerboard provided on an instrument body;

at least one string stretched on said instrument body;

at least one operation-area formed on said fingerboard and having operation positions defined with respect to said at least one string;

detecting means for detecting operation of particular operation positions;

timing-designation means for designating said particular operation-positions detected by said detection means as plucking-timing positions indicating generation timings for a group of plucking sounds to be sequentially generated at predetermined time intervals;

memory means;

string-vibration detecting means for detecting vibration of said at least one string; and writing means for writing plucking-timing data into said memory means when said string-vibration detecting means detects vibration of said at least one string and said detection means detects operation of said particular operation positions, said plucking-timing data corresponding to said particular plucking-timing positions designated by said timing-designation means.

44. A plucking data memory instrument comprising:

a fingerboard provided on an instrument body;

at least one string stretched on said instrument body;

at least one operation-area formed on said fingerboard and having operation positions defined with respect to said at least one string;

detecting means for detecting operation of particular operation positions;

timing-designation means for designating said particular operation-positions detected by said detection means as plucking-timing positions indicating generation-timings for plucking sounds to be generated;

memory means;

string-vibration detecting means for detecting vibration of said string; and writing means for writing plucking-timing data into said memory means when said string-vibration detecting means detects vibration of said at least one string and said detection means detects operation of said particular operation positions, said plucking-timing data corresponding to said particular plucking-timing positions designated by said timing-designation means.

45. A plucking data memory instrument comprising:

a fingerboard provided on an instrument body;

at least one string stretched on said fingerboard;

at least one operation-area formed on said fingerboard and having operation positions defined with respect to said at least one string;

detecting means for detecting operation of particular operation positions;

timing-designation means for designating said particular operation-positions detected by said detection means as plucking-timing positions indicating generation-timings for a group of plucking sounds to be sequentially generated at predetermined time intervals;

memory means; and writing means for writing plucking-timing data into said memory means, when said detection means has detected said particular operation-positions, said plucking-timing data corresponding to said particular plucking-timing positions designated by said timing designation means.

46. A plucking data memory instrument comprising:

a fingerboard provided on an instrument body;

at least one string stretched on said fingerboard;

at least one operation-area formed on said fingerboard and having operation positions defined with respect to said at least one string;

detecting means for detecting operation of particular operation positions;

timing-designation means for designating said particular operation-positions detected by said detection means as plucking-timing positions indicating generation-timings for plucking sounds to be generated;

memory means; and writing means for writing plucking-timing data into said memory means, when said detection means has detected said particular operation-positions, said plucking-timing data corresponding to said particular plucking-timing positions designated by said timing designation means.

* * * * *